US006870937B1

(12) United States Patent
Hirosaki et al.

(10) Patent No.: US 6,870,937 B1
(45) Date of Patent: Mar. 22, 2005

(54) ELECTROACOUSTIC TRANSDUCER, PROCESS OF PRODUCING THE SAME AND ELECTROACOUSTIC TRANSDUCING DEVICE USING THE SAME

(75) Inventors: Yuji Hirosaki, Tenri (JP); Kiyoaki Tanaka, Nishinomiya (JP); Shiro Kimura, Nara (JP); Ikuo Yamamoto, Souraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 200 days.

(21) Appl. No.: 09/692,222

(22) Filed: Oct. 20, 2000

(30) Foreign Application Priority Data

Dec. 9, 1999 (JP) ..... 1999-350277
Jul. 31, 2000 (JP) ..... 2000-231329

(51) Int. Cl.[7] ..... H04R 25/00
(52) U.S. Cl. ..... 381/174; 381/191
(58) Field of Search ..... 381/174, 191, 381/175; 367/181, 162, 163, 176, 174, 171; 310/324; 427/209

(56) References Cited

U.S. PATENT DOCUMENTS 5,303,210 A 4/1994 Bernstein ..... 367/181
5,452,268 A * 9/1995 Bernstein
5,889,872 A * 3/1999 Sooriakumar et al. ..... 381/174

FOREIGN PATENT DOCUMENTS

JP 04127479 A 4/1992
JP 07-333077 12/1995
JP 11-266499 9/1999
JP 2001-518246 10/2001
WO 84/03410 8/1984

* cited by examiner

*Primary Examiner*—Sinh Tran
(74) *Attorney, Agent, or Firm*—Nixon & Vanderhye P.C.

(57) ABSTRACT

An electroacoustic transducer comprises: a lower electrode; an upper electrode including an oscillation portion and a support portion for supporting the oscillation portion at least at a part of a periphery of the oscillation portion; and an insulating layer for insulating the lower electrode from the upper electrode, wherein the upper electrode has an up and down in the oscillation portion and/or in the support portion to provide a cavity between the upper electrode and the lower electrode.

24 Claims, 17 Drawing Sheets

ELECTROACOUSTIC TRANSDUCER, PROCESS OF PRODUCING THE SAME AND ELECTROACOUSTIC TRANSDUCING DEVICE USING THE SAME

CROSS-REFERENCES TO RELATED APPLICATIONS

This application is related to Japanese Patent Applications Nos. H11(1999)-350277 and 2000-231329, filed on Dec. 9, 1999 and Jul. 31, 2000 whose priorities are claimed under 35 USC § 119, the disclosures of which are incorporated by reference in their entirety.

BACKGROUND OF THE INVENTION

1. Field of the Invention

The present invention relates to an electroacoustic transducer, a process of producing the same and an electroacoustic transducing device using the same.

2. Description of Related Art

There have been proposed semiconductor devices in which capacitors capable of functioning as electroacoustic transducers such as microphones are integrated in semiconductor chips (see W084/03410, for example).

As shown in FIG. 21(*e*), such a capacitor is composed of an oscillation film 82 serving as one electrode of the capacitor which film is formed on a semiconductor substrate 81 having a cavity 81*a*, a support portion 83 of a silicon nitride film for ensuring a cavity 84*a* in a region corresponding to the cavity 81*a* of the semiconductor substrate 81, a polysilicon film 85 serving as another electrode of the capacitor formed to extend from above the support portion 83 over a part of the cavity 84*a* and an insulating film 87 formed on the polysilicon film 85 to substantially cover the cavity 84*a* with a small hole 87*a* above the cavity 84*a*.

This capacitor is produced by the following process with connection to FIGS. 21(*a*) to 21(*e*).

First, as shown in FIG. 21(*a*), a diffusion layer to be the oscillation film 82 which is one electrode of the capacitor is formed on a top surface of the semiconductor substrate 81, and then, the support portion 83 is selectively formed of a silicon nitride film in a desired shape on the diffusion layer.

Subsequently, as shown in FIG. 21(*b*), a PSG film 84 is buried to have the same surface level as the support portion 83, on a part of the resulting semiconductor substrate 81 in which part the support portion 83 does not exist and the diffusion layer is exposed.

Next, as shown in FIG. 21(*c*), a polysilicon film 85 to be the other electrode of the capacitor is formed both on the PSG film 84 and on the support portion 83. At this time, the polysilicon film 85 is formed to expose a part of the surface of the PSG film 84.

Subsequently, as shown in FIG. 21(*d*), insulating films 87 are formed on the top surface and a bottom surface of the resulting semiconductor substrate 81. A small hole 87*a* is formed in the insulating film 87 on the top surface of the semiconductor substrate 81 and an opening 87*b* is formed in the insulating film 87 on the bottom surface of the semiconductor substrate 81.

Thereafter, as shown in FIG. 21(*e*), a cavity 84*a* is formed between the diffusion layer and the polysilicon film 85 by etching the PSG film 84 via the small hole 87*a* while the bottom surface of the semiconductor substrate 81 is etched until the diffusion layer is exposed, thereby to form an opening 81*a*. Thus the oscillation film 82 is completed.

In the above-described capacitor, the oscillation film 82 which is one electrode of the capacitor is formed inside at a certain distance from the surface of the resulting semiconductor substrate 81. The polysilicon film 85 which is the other electrode of the capacitor is formed on the surface of the resulting semiconductor substrate. With this construction, a sound wave (acoustic signal) input from the opening 81*a* oscillates the oscillation film 82, thereby changes the distance between the oscillation film 82 and the polysilicon film 85 which are the electrodes of the capacitor and further changes the capacitance of the capacitor. Thus generated is an electric signal equivalent to the acoustic signal.

However, the capacitor with the above-described structure has the problem of difficulty in controlling the thickness of the oscillation film 82 since the oscillation film 82 which is one electrode is formed through thinning the semiconductor substrate 81 by etching.

On the other hand, proposed is a capacitor which provides an easy control of the thickness of the oscillation film by having two electrodes on a semiconductor substrate, though this capacitor does not function as an electroacoustic transducer but functions as a pressure sensor for detecting pressure from the outside (see Japanese Unexamined Patent Publication No HEI 4(1992)-127479).

As shown in FIG. 22, a capacitor of this type is provided with a p-type diffusion layer 92, which is one electrode of the capacitor, formed on a n-type silicon substrate 91, a support layer 94 formed on the p-type diffusion layer 92 with intervention of an oxide film 93, and a polysilicon film 96, which is the other electrode of the capacitor, formed on the support layer 94 with intervention of an oxide film 95. The oxide film 95 is formed to completely cover the support layer 94 and ensure a cavity 94*a* in the support layer 94. A plurality of small holes 95*a* are formed in the oxide film 95 above the cavity 94*a*. The p-type diffusion layer 92 and the polysilicon layer 96, which are the electrodes of the capacitor, are connected to different wiring layers 97 and 98, respectively.

This capacitor is produced by the following process.

First, the p-type diffusion layer 92 is formed by impurity implantation at a high concentration into the surface of the n-type silicon substrate 91. Thereafter, the resulting silicon substrate 91 is entirely covered with the oxide film 93, on which the support layer 94 of polysilicon is formed in a plateau shape. The support layer 94 is entirely covered with the oxide film 95. A plurality of small holes 95*a* are formed in the oxide film 95. Through these small holes 95*a*, the polysilicon of the support layer 94 is partially etched away so as to form the cavity 94*a*.

Further, a polysilicon film 96 is grown to cover the oxide film 95 by CVD method and seal the cavity 94*a*. The polysilicon film 96 is patterned by photo-etching to form the other electrode of the capacitor above the cavity 94*a*. The sealed pressure in the sealed cavity 94*a* at this time is a reference pressure for pressure detection.

Subsequently, another oxide film 99 is formed on the polysilicon film 96 and openings are formed in the oxide film 99 above the polysilicon film 96 and the p-type diffusion layer 92. A conductor film is formed and patterned to make the wiring layers 97 and 98 which are connected to the p-type diffusion layer 92 and the polysilicon film 96, respectively, via the openings.

In this pressure sensor, the polysilicon film 96 on the cavity 94*a* forms a diaphragm as an elastic member. When the polysilicon film 96 is distorted by external pressure, the pressure is detected or measured by comparing a change in electrostatic capacity between the p-type diffusion layer 92 and the polysilicon film 96 with electrostatic capacity corresponding to the reference pressure.

In this pressure sensor, however, since the polysilicon film 96 which is the other electrode of the capacitor is formed after the cavity 94*a* is formed, the polysilicon film 96 is warped toward the semiconductor substrate 91 and a sufficient tension cannot be ensured. If the tension of the polysilicon film 96 is extremely low, the oxide film 95 comes in contact with the p-type diffusion layer 92 which is one electrode of the capacitor. For this reason, if this pressure sensor is applied to a capacitor for generating electric signals equivalent to acoustic signals, frequency characteristics are limited within a certain range. Accordingly sufficient acoustic characteristics cannot be obtained, and electric signals equivalent to acoustic signals themselves cannot be generated. Therefore, the capacitor cannot be applied to an electroacoustic transducer such as a microphone or the like.

Further, since the cavity 94*a* is completely sealed with the polysilicon film 96, the cavity 94*a* swells if the external pressure becomes lower than the pressure in the cavity 94*a*, and the cavity 94*a* shrinks if the external pressure becomes higher than the pressure in the cavity 94*a*. Thus the acoustic characteristics deteriorate.

SUMMARY OF THE INVENTION

In view of the above-described circumstances, an object of the present invention is to provide an electroacoustic transducer which provides an easy control of the thickness of the oscillation film, one electrode of the capacitor, ensures an appropriate tension for the oscillation film and therefore exhibits good acoustic characteristics, and its production process.

The present invention provides an electroacoustic transducer comprising a lower electrode; an upper electrode including an oscillation portion and a support portion for supporting the oscillation portion at least at a part of a periphery of the oscillation portion; and an insulating layer for insulating the lower electrode from the upper electrode, wherein the upper electrode has an up and down in the oscillation portion and/or in the support portion to provide a cavity between the upper electrode and the lower electrode.

In another aspect, the present invention provides a process of producing an electroacoustic transducer comprising the steps of:

(a) forming an insulating layer selectively on a lower electrode so that a surface of the lower electrode is partially exposed;
(b) forming a sacrificial film selectively on the exposed surface of the lower electrode and in a region on the insulating layer surrounding the exposed surface of the lower electrode;
(c) forming an upper electrode on the sacrificial film, the upper electrode exposing a part of the sacrificial film and covering a part of the periphery of the sacrificial film to extend onto the insulating layer; and
(d) forming a cavity between the upper electrode and the lower electrode by removing the sacrificial film through the exposed part of the sacrificial film.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1A:
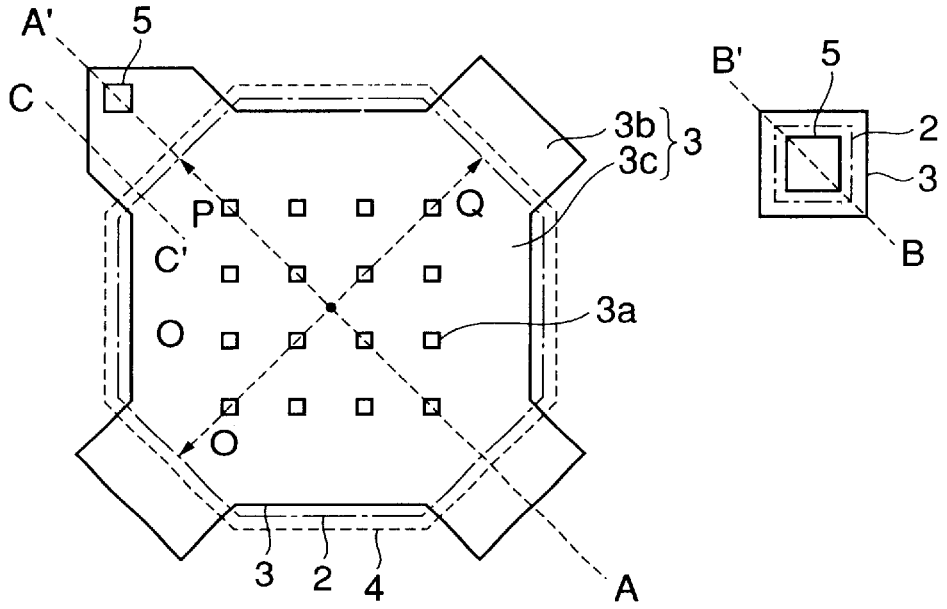
FIG. 1(*a*) is a schematic plan view of a major part illustrating a first embodiment of an electroacoustic transducer in accordance with the present invention, FIG. 1(*b*) is a sectional view taken along line A–A' in FIG. 1(*a*), and FIG. 1(*c*) is a sectional view taken along line B–B' in FIG. 1(*a*)

The electroacoustic transducer of the present invention has a capacitor-type structure whose capacitance is formed of the cavity (air) and is comprised mainly of the lower electrode, the upper electrode and the insulating layer disposed between the lower electrode and the upper electrode.

Materials for the lower electrode are not particularly limited so long as they are electrically conductive. Examples thereof include amorphous, monocrystalline or polycrystalline n-type or p-type elementary semiconductors (e.g., silicon, germanium, etc.) or compound semiconductors (e.g., GaAs, InP, ZnSe, CsS, etc.); metals such as gold, platinum, silver, copper, aluminum and the like; refractory metals such as titanium, tantalum, tungsten and the like; and suicides and poiycides with refractory metals, and the like. The lower electrode may be formed of a single-layer film or a multi-layer film of a material/materials as mentioned above. Among these materials, those used as substrates for semiconductor devices are preferable. More particularly, monocrystalline or polycrystalline n-type or p-type semiconductor substrates, especially silicon substrates, are preferable. The lower electrode may also be formed of a film of the above-mentioned conductive material formed with intervention of an insulating film on a semiconductor substrate having a so-called multi-layer wiring structure in which semiconductor devices such as transistors and capacitors, circuits, insulating films, wiring layers and the like are formed in combination. Also the lower electrode may be formed as a top semiconductor layer of an SOI substrate or a multi-layer SOI substrate. The thickness of the lower electrode in this case is not particularly limited. In the case where the lower electrode is formed of a semiconductor substrate, semiconductor devices, circuits, insulating films, wiring layers and the like may be formed in combination in other regions of the semiconductor substrate than the lower electrode, p-type or n-type diffusion layers may be formed on the surface of the semiconductor substrate, and trenches, islands and others may be formed on the surface of the semiconductor substrate.

Materials for the upper electrode are not particularly limited so long as they are electrically conductive. The same materials as mentioned for the lower electrode may be mentioned here. Especially, the upper electrode may preferably be formed of a polysilicon film. If the polysilicon film is used as the upper electrode, the sheet resistance of the polysilicon film may preferably be adjusted to such a degree that parasitic resistance can be so suppressed that the output sensitivity of the electroacoustic transducer is not decreased, for example, to about several to several tens $\Omega.cm^{-2}$. The upper electrode preferably has a uniform thickness, but it may be thicker or thinner partially. Suitably, the thickness of the upper electrode is within the range of about 1 to about 2 $\mu$m.

The upper electrode is composed of the oscillation portion and the support portion.

Figure 1B:
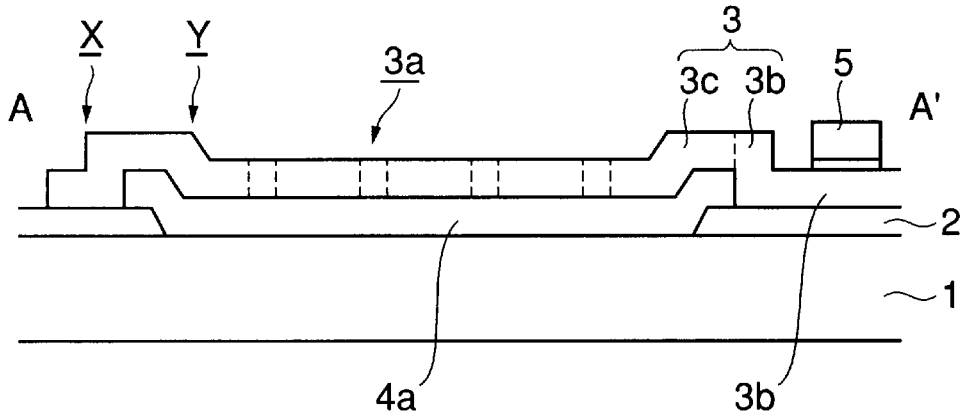
Figure 1C:
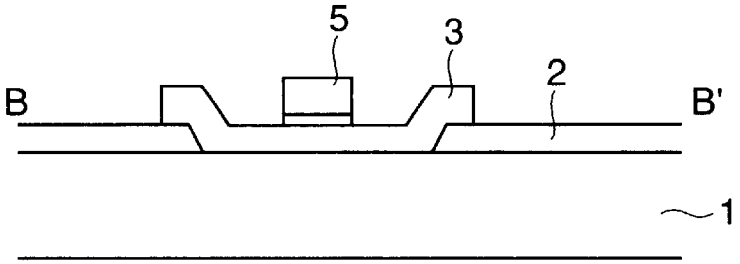
Figure 2A:
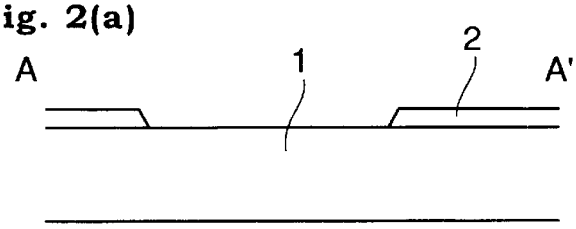
FIGS. 2(*a*) to 2(*e*) and 2(*a'*) to 2(*e'*) are schematic sectional views of a major part illustrating a process of predicting the electroacoustic transducer shown in FIGS. 1(*a*) to 1(*c*)
Figure 2A:
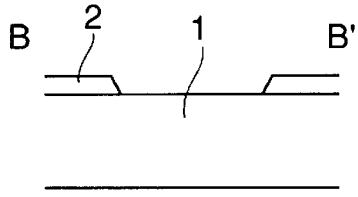
Figure 2B:
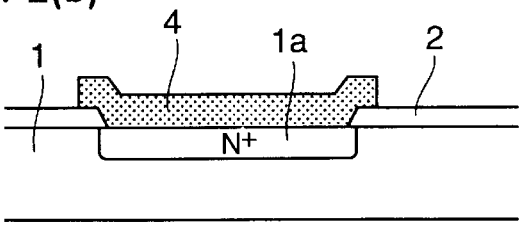
Figure 2B:
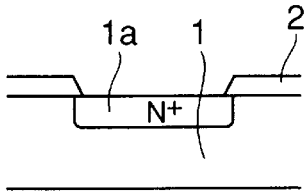
Figure 2C:
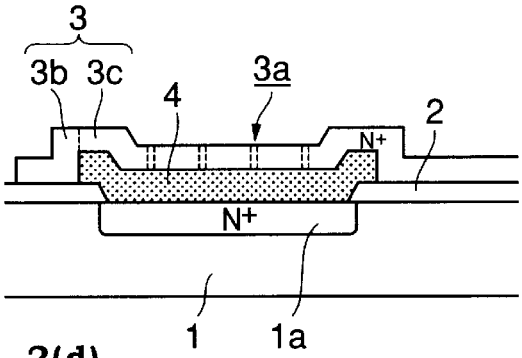
Figure 2C:
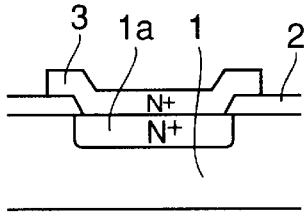
Figure 2D:
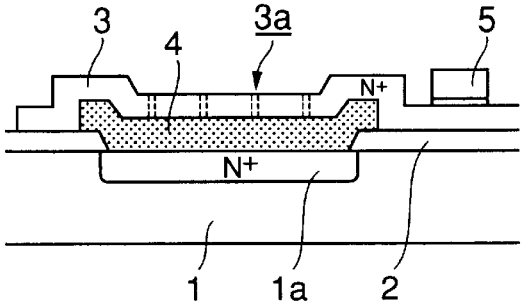
Figure 2D:
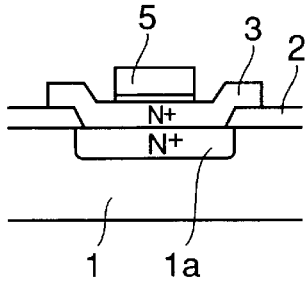
Figure 2E:
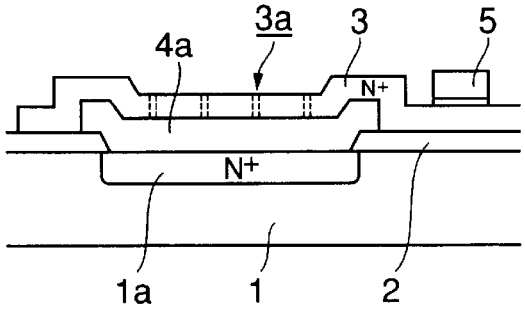
Figure 2E:
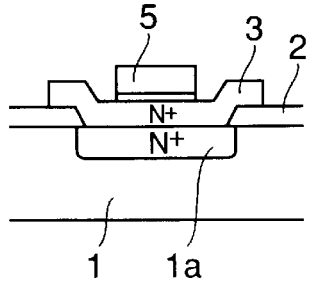

The oscillation portion means a part of the upper electrode right above the cavity (see 3*c* in FIG. 1(*b*), for example), that is, a part of the upper electrode corresponding to an area of an image of the cavity projected from a lower electrode side onto the upper electrode. The oscillation portion has the function of changing the capacity between the upper and lower electrodes by being oscillated by an external sound. The shape of the oscillation portion is not particularly limited, but may be set as appropriate according to the position, number, size and the like of the support portion detailed later. For example, the oscillation portion may be circular or polygonal. Suitably, the distances from the center of the oscillation portion to its sides (or circumference) are the same (e.g., P=Q=O in FIG. 1(*a*)), and the oscillation portion may preferably be in the shape of a circle, a substantial circle, an equilateral polygon or a substantially equilateral polygon in which corners of a corresponding equilateral polygon are cut off, among which equilateral hexagon and equilateral octagon are more preferable, and equilateral hexagon may particularly be preferable. The size of the oscillation portion is not particularly limited, but may be, for example, about $1.0\times10^5$ to about $40.0\times10^5$ $\mu m^2$ and, more particularly, about $2.5\times10^5$ to about $14.4\times10^5$ $\mu m^2$.

Preferably, the oscillation portion has one or more small holes, whose diameter may preferably be about 2 to about 10 $\mu$m, for example. The number of small holes may vary depending on the size of the oscillation portion, but if the oscillation portion has a size within the above-mentioned range, the number of the small holes may be about 100 or less, preferably about 60 to about 90.

The support portion is for supporting the oscillation portion at least at a part of the periphery of the oscillation portion. The support portion occupies other part of the upper electrode than the above-described oscillation portion. The support portion is suitably formed at least at two positions, preferably at three positions, which are at the same distance from the center of the oscillation portion. Preferably, the support portion supports the oscillation portion at such a ratio with respect to the total circumference of the oscillation portion that the support portion can maintain the oscillation of the oscillation portion effectively and can provide a proper tension to the oscillation portion, for example, about 50% or less of the total circumference of the oscillation portion.

The upper electrode is contoured. In other words, the upper electrode has an up and down. The up and down of the upper electrode means that a bottom face (a face facing the lower electrode detailed later) of the upper electrode alone, a top face (a face opposite to the face facing the lower electrode) of the upper electrode alone or both the bottom and top faces of the upper electrode has a stepwise or gradually changing distance from a top face (a face facing the upper electrode) of the lower electrode.

Here the expression "stepwise" means that the distance between the bottom and/or top face(s) of the upper electrode and the top face of the lower electrode changes abruptly, that is, the bottom and/or top face(s) of the upper electrode have/has at least two faces having different distances from the top face of the lower electrode. The expression "gradually" means that the distance between the bottom and/or top face(s) of the upper electrode and the top face of the lower electrode changes gently, that is, the distance between the bottom and/or top face(s) of the upper electrode and the top face of the electrode changes but the change of the distance is not on the basis of different faces. Having the up and down only on the bottom face or only on the top face of the upper electrode means that the thickness of the upper electrode changes partially and an up and down, i.e., a projection or a depression, is formed on the bottom face or on the top face. Having the up and down on both the bottom and top faces of the upper electrode means that the thickness of the upper electrode is substantially uniform and the up and down is formed by a curve or bend of the upper electrode.

By having the up and down, the upper electrode may have only one depression or projection (see FIG. 7 or 9, for example), a plurality of depressions and/or projections, one or more depression(s) and/or projection(s) in a depression, and one or more depression(s) and/or projection(s) in a projection (see FIG. 1(*b*), for example). The up and down may be formed only on the top face (see FIG. 7), only on the bottom face or only on the top and bottom faces of the support portion; only on the top face, only on the bottom face or only on the top and bottom faces (see FIG. 9, for example) of the oscillation portion; or on the top face, on the bottom face or on the top and bottom faces of the support portion and on the top face, on the bottom face or on the top and bottom faces of the oscillation portion (see FIG. 1(*b*), 6 and 8, for example). Preferably, the up and down is formed only on the top face of the support portion (see FIG. 7, for example), only on the top and bottom faces of the oscillation portion (see FIG. 9, for example), or on the top face of the support portion and on the top and bottom faces of the oscillation portion (see FIGS. 1(*b*), 6 and 8, for example). The up and down, if it is on the oscillation portion, is preferably formed by a curve of the oscillation portion in the vicinity of an edge of the insulating layer detailed later. Here the vicinity of the edge of the insulating layer in the upper electrode means a region in the upper electrode which region is located within a distance of about 1% of the largest width of the oscillation portion from the edge of the insulating layer lying under the upper electrode. More particularly, it means a region of the upper electrode which region is located within a distance of about 10 $\mu$m from the edge of the insulating layer.

Further, by providing the upper electrode with the up and down, the bottom face of an end part of the oscillation portion is preferably at a higher level than the top face of a region of the support portion extended right above the insulating film (see FIGS. 6, 7 and 8, for example) or at a lower level than that, or at the same level as the top face of the support portion (see FIG. 1(*b*), for example). Here the difference in level between the bottom face of the end part of the oscillation portion and the top face of the region of the support portion extended right above the insulating layer is not particularly limited, but may be adjusted as appropriate according to the thickness of the upper electrode, the height of the cavity and the like. Thus, it is possible to ensure uniform transmission of oscillation caused by sound while providing an appropriate tension to the oscillation portion and preventing the contact of the upper electrode with the lower electrode. Especially, in the case where the bottom face of the end part of the oscillation portion is higher than the top face of the region of the support portion extended right above the insulating layer, the support portion can further absorb excessive oscillation to the oscillation film so that the upper electrode can be prevented from breaking. On the other hand, in the case where the bottom face of the end part of the oscillation portion is lower than or at the same level as the top face of the region of the support portion extended right on the insulating layer, the volume of the cavity can be reduced and thereby the output sensitivity can be improved.

The oscillation portion preferably has a uniform thickness without ups and downs in its central part. However, it may have, in its peripheral area, a plurality of faces (regions) having different distances from the top face of the lower electrode in addition to the up and down in the vicinity of the edge of the insulating layer (see FIG. 12(*b*), for example). Here, the periphery of the oscillation portion means a region of the oscillation portion within a distance of about 10%, preferably about 8%, of the largest width of the oscillation portion from its outer edge toward the center of the oscillation portion. More particularly, it means a region having a distance within about 100 $\mu$m, preferably about 80 $\mu$m, from its outer edge toward the center of the oscillation portion. Said plurality of faces having different distances from the top face of the lower electrode may be realized by forming one or more, preferably two to three, depressions or projections. In this case, the intervals between the depressions or projections may suitably be about 10 to about 20 $\mu$m, for example.

The cavity is formed between the lower electrode and the upper electrode by the up and down in the upper electrode. The cavity is an open space which contacts the air at a part of the cavity. The cavity is preferably formed substantially only by the up and down in the upper electrode, but may be formed by intervention of the insulating film detailed later between the upper electrode and the lower electrode in addition to the up and down in the upper electrode. The height of the cavity is required to be such that the upper electrode does not contact the lower electrode and also desired acoustic characteristics can be obtained. For example, the height may be within the range of about 1 to about 3 $\mu$m. The cavity may have a uniform height, but may also be partially lowered or elevated. The size of the cavity may vary according to the multitude of the voltage applied to the electroacoustic transducer to be produced, the desired acoustic characteristics and the like. For example, the cavity may occupy an area of about $1.0\times10^5$ to about $40.0\times10^5$ $\mu m^2$.

The insulating layer has the function of preventing the contact of the upper electrode with the lower electrode and ensuring insulation between them. In some cases, the insulating layer may have the function of holding a part of the cavity. Materials for the insulating layer are not particularly limited so long as they are insulative. The insulating layer may be formed of a silicon nitride film, a silicon oxide film, a laminate of these films or the like, for example. The thickness of the insulating layer may be about 0.5 to about 1.2 $\mu$m, for example. It suffices that the insulating layer is formed at least in a region where it can prevent a direct contact of the upper electrode with the lower electrode, but the insulating film may also be formed over regions other than the region functioning as the lower electrode.

The electroacoustic transducer of the present invention may have a wall surrounding the oscillation portion of the upper electrode, the support portion of the upper electrode and/or a region extending over the oscillation portion and the support portion of the upper electrode. The wall may be formed of an electrically conductive or insulative material, for example, a semiconductor such as silicon, germanium or the like, a metal such as Au, Ni, Ag, Cu or the like, a refractory metal such as Ti, Ta, W or the like, an alloy of these metals or the like, among which metals such as Au, Ni, Ag and the like, capable of being shaped easily by plating, are preferable.

The wall may be arranged to form a closed curve such as surrounds all the upper electrode, arranged in a plurality of rectangles such as surround the upper electrode, arranged to form double, triple, . . . closed curves or open walls. Preferably the wall forms the closed curve(s). The shape of the wall is not particularly limited. However, the wall may preferably be so formed that its height becomes smaller toward the center of the oscillation portion, though the wall may have a flat top face substantially parallel to the surface of the lower electrode. Here, that the height becomes smaller toward the center means that a single wall or each of a plurality of walls may reduce its height stepwise or inclinedly toward the center and also that a plurality of walls may reduce their heights stepwise or inclinedly toward the center. In the case where a plurality of walls are formed, all the walls do not need to have the same height, width or the like. The height and width of the walls may be adjusted as appropriate within the range of about 5 to about 30 $\mu$m and the range of about 20 to about 100 $\mu$m, respectively. By adjusting the height, interval, width and the like of the wall(s), the sound collecting effect, directivity and/or the like can be optimized.

Further, in the electroacoustic transducer of the present invention, the upper electrode and the lower electrode are preferably connected to respective terminals for applying voltage, respectively. The terminals may be formed of any electrically conductive materials that are usually used for terminals of electrodes, but may preferably be formed of a non-oxidizable, corrosion-resistant metal such as gold, platinum or the like. If the upper electrode and/or the lower electrode are/is formed of a semiconductor material, it is preferable that a highly doped impurity layer is formed in a region contacting the terminal for reducing a contact resistance with the terminal. The concentration of an impurity in this case may be in an about $1.0\times10^{19}$ to about $1.0\times10^{20}$ ions/cm$^3$ order.

The electroacoustic transducer of the present invention is applicable for microphones, speakers and the like. Especially, it enables size-reduction and advancement in performance of such equipment by integrating the transducer with semiconductor devices. More particularly, the electroacoustic transducer can be applied for portable phones, sound input/output devices of computers, small-sized recording/reproduction devices in semiconductor information devices and the like.

The electroacoustic transducing device of the present invention can also be realized by combining a number of the above-described electroacoustic transducers or optionally combining the electroacoustic transducer(s) with other desired device(s).

For producing the electroacoustic transducer of the present invention, first in step (a), the insulating film is formed on the lower electrode selectively so that the lower electrode is partially exposed. The lower electrode can be formed by a known method. For example, in the case where the lower electrode is formed of a semiconductor substrate, the lower electrode can be formed by doping the semiconductor substrate with a desired impurity and setting a certain resistivity. Or in the case where the lower electrode is formed of an electrically conductive single-layer or multilayer film, the lower electrode can be formed by forming an electrically conductive material film on a suitable substrate by sputtering, vapor deposition, CVD method or the like and pattering the formed film into a desired form.

The selective formation of the insulating layer may be performed by a known method, for example, by forming a film of an insulative material on the entire surface of the lower electrode and patterning the film into a desired shape by photolithography and etching method. The insulating film here may be patterned using a mask pattern having an opening only on a part of the lower electrode or using a mask pattern covering only a part of the lower electrode. The thickness of the insulating layer is not particularly limited and may be about 0.5 to about 1.2 $\mu$m.

In step (b), a sacrificial film is formed selectively on the exposed part of the lower electrode and on a region of the insulating layer which surrounds the exposed part of the lower electrode. The selective formation of the sacrificial film may be performed by substantially the same method as mentioned in step (a) for forming the insulating layer. The sacrificial film here needs to be formed to extend from immediately above the lower electrode to overlap the insulating layer. The extent of overlap or width of an overlapped portion here can be adjusted as appropriate according to the size, performance and others of the electroacoustic transducer to be produced and may be about 5 to about 50 $\mu$m, for example, and further about 10 to about 30 $\mu$m. The sacrificial film is preferably formed of a material having a greater etching rate than the materials of the lower electrode, the upper electrode, the insulating film and the like when etched by a certain etching method under certain etching conditions. Examples of such materials include PSG, SOG, BPSG, $SiO_2$ and the like. The thickness of the sacrificial film is not particularly limited, but may be about 1 to about 3 $\mu$m, for example.

If a phosphorus-doped silicon oxide film is used as the sacrificial film, it is preferable that, after the sacrificial film is formed on the entire surface of the lower electrode, the film is thermally treated at a temperature such that the surface of the film can be smoothed. The thermal treatment here can be set as appropriate according to the type, thickness and the like of the sacrificial film and may be performed at a temperature of about 900 to about 1000° C. for about 10 to about 100 minutes.

If SOG is used for the sacrificial film, such thermal treatment is not required to be carried out separately. Furthermore, since SOG has a relatively large etching rate, the etching time can be reduced. Therefore, the production process can be simplified.

If a plurality of faces having different distances from the lower electrode are formed in the outer periphery of the oscillation portion of the upper electrode as described above, preferably, a resist pattern having a predetermined line width is formed in a proper place on the sacrificial film, and then using this resist pattern as a mask, the surface of the sacrificial film is etched to a predetermined depth to form an up and down or a projection and a depression thereon. Thereby, the upper electrode is formed on the sacrificial film which has the up and down or the projection and depression on its surface, in a later step, and as a result, the upper electrode itself presents the up and down or the projection and depression according to those of the sacrificial film. The height of the up and down or the projection and depression formed on the surface of the sacrificial film is not particularly limited, but may be such that a sufficient tension can be provided to the oscillation portion of the upper electrode to be formed in a later step, for example, about 0.3 to about 1.0 $\mu$m. Additionally, the formation of the up and down or the projection and depression on the sacrificial film involves the etching of the sacrificial film once formed, which reduces the thickness of the sacrificial film. Therefore, it is necessary to form a thicker sacrificial film at first in consideration of the reduction in thickness by the etching.

In step (c), the upper electrode is formed on the sacrificial film. The upper electrode exposes a part of the sacrificial film, covers a part of the peripheral edge of the sacrificial film and extends onto the insulating layer. As described above, the upper electrode is formed into a shape such that the oscillation portion is supported by the support portion at least at a single place, usually at two or more places. Accordingly, the upper electrode here is shaped to expose the sacrificial film partially and extend over onto the insulating film, covering the peripheral edge of the sacrificial film partially. That is, the upper electrode is projected/extended from the oscillation portion in a region where it forms the support portion, covers the sacrificial film in a region where it forms the oscillation portion, and further exposes the sacrificial film in the outer periphery of the region where the oscillation portion is formed. The upper electrode can be formed similarly to the formation of the lower electrode of a single-layer or multi-layer film of electrically conductive materials.

After or simultaneously with the formation of the upper electrode, small holes are preferably formed to reach the sacrificial film in the region defining the oscillation portion, so as to facilitate the removal of the sacrificial film in a later step. The small holes may be formed simultaneously with the upper electrode by forming a film of the material for the upper electrode on the entire surface and patterning the film into a desired shape using a mask having a pattern corresponding to the upper electrode and also having openings corresponding to the small holes. Alternatively, the small holes may be formed, after the patterning of the upper electrode, by etching the upper electrode using a mask having openings only in sites where the small holes are to be formed.

In step (d), the sacrificial film is removed through a place where the sacrificial film is exposed. Preferably, the sacrificial film is removed substantially completely. The removal of the sacrificial film can be performed by various methods such as dry etching, wet etching and the like. However, it may preferably be performed by wet etching using an etchant which is capable of etching only the sacrificial film selectively. More particularly, may be mentioned a method of immersing the sacrificial film for about 1 to 10 minutes in an etchant containing one or more of HF, phosphoric acid, sulfuric acid, nitric acid and the like or preferably in an HF-containing etchant. In the case where the small holes are formed in the upper electrode, the removal of the sacrificial film can be completed in a shorter time since the sacrificial film can contact the etchant in a larger area. Thus, the cavity is formed between the lower and upper electrodes.

The electroacoustic transducer and the process of producing the device of the present invention are now described in detail with reference to the attached drawings.

First Embodiment

As shown in FIG. 1(*a*) to 1(*c*), the electroacoustic transducer of this embodiment is composed of a lower electrode formed of a silicon substrate 1, an upper electrode formed of a polysilicon film 3 including an oscillation portion 3*c* and support portions 3*b* extended from four places on the periphery of the oscillation portion 3*c*, a cavity 4*a* formed between the lower electrode and the upper electrode, and an insulating layer of a SiN film 2 disposed between the lower electrode and the upper electrode. The insulating layer, as indicated by an alternate long and short dash line in FIG. 1(*a*), covers almost the entire surface of the silicon substrate 1 except that it has openings almost immediately under the oscillation portion 3*c* of the upper electrode and in a region for connecting a terminal to the lower electrode.

The oscillation portion 3*c* of the upper electrode is in the shape of a substantially equilateral octagon, and the distances O, P and Q from its center to the support portions 3*b* are the same. Each of the support portions 3*b* has an up and (down, X and Y, from just above the insulating layer toward just above the center of the cavity 4*a*. The upper electrode has such ups and downs at four places. A plurality of small holes 3*a* are formed in the oscillation portion 3*c*. Further, the lower face of the end portions of the oscillation portion 3*c* is positioned at the same level as the upper face of the support portions 3*b* extended onto the insulating layer.

A terminal of a Au/TiW film 5 is formed in the periphery of this electroacoustic transducer and is connected to the lower electrode (silicon substrate 1). Another terminal of a Au/TiW film 5 is formed on the support portion 3*b* and is connected to the upper electrode.

This electroacoustic transducer was produced by the following production process.

First, as shown in FIGS. 2(*a*) and 2(*a*'), a SiN film 2 of about 1.2 $\mu$m thickness was formed by LP-CVD method on the entire surface of an n-type silicon substrate 1 (having a thickness of about 625 $\mu$m and a resistivity of 3 to 6 Ω/□) which was to be one electrode of the electroacoustic transducer, using a gas of $NH_3$+$SiH_2Cl_2$ at a deposition temperature of about 750 to about 850° C. Subsequently, the SiN film 2 was patterned by photo-etching into a desired shape (indicated by the alternate long and short dash line in FIG. 1(*a*)) having an opening of a substantially equilateral octagon and an opening for connection to the lower electrode.

Subsequently, as shown in FIGS. 2(*b*) and 2(*b*'), arsenic or phosphoric ions were implanted at a dose of about 1 to $8\times10^{15}$ ions/cm$^2$ using the insulating layer as a mask, to form an n-type diffusion layer 1*a* in the surface of the silicon substrate 1. It is noted that it suffices that this n-type diffusion layer 1*a* is formed at least immediately under the opening for connection of the lower electrode. Subsequently, a PSG film 4 was deposited to a thickness of about 1 to about 3 $\mu$m as a sacrificial film on the entire surface of the resulting silicon substrate 1, using a gas of $SiH_4$+$PH_3$ at a deposition temperature of about 350 to about 450° C. The thickness of this PSG film 4 can determine the height of the cavity to be formed between the lower electrode and the upper electrode. Thereafter, for reducing a level difference in the PSG film 4, thermal treatment was performed within the temperature range of about 900 to about 1000° C. for about several tens of minutes.

Figure 3A:
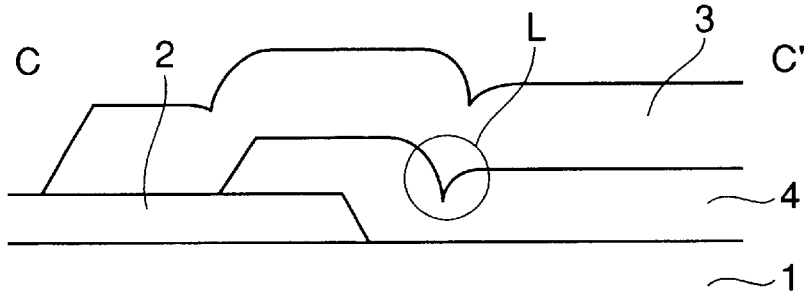
FIGS. 3(*a*) and 3(*b*) are schematic sectional views of a major part illustrating an effect of thermal treatment of a sacrificial film.
Figure 3B:
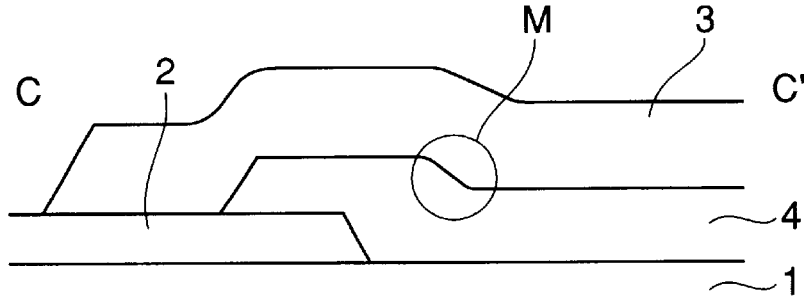

Here, the thermal treatment of the PSG film 4 reduces a level difference M in the PSG film 4 between the insulating film and the silicon substrate 1 as shown in FIG. 3(*b*). However, if the thermal treatment is not performed, a polysilicon film 3 to be formed on the PSG film 4 in a later step goes into a portion L presenting the level difference in the PSG film 4 between the insulating film and the silicon substrate 1 as shown in FIG. 3(*a*). When the PSG film 4 is etched to form the cavity, the polysilicon film 3 in the portion L having the level difference contacts the silicon substrate 1 and gives rise to a short circuit between the upper electrode and the lower electrode.

Next, the PSG film 4 was patterned by photo-etching to remain where the cavity was to be formed in a later step. This patterning was performed by immersing the PSG film 4 into a HF etchant for about four minutes. The patterning of the PSG film 4 was such that the PSG film 4 overlapped the insulating film by about 10 to about 30 $\mu$m. This overlap was for providing the up and down in the upper electrode and thereby facilitating the oscillation of an oscillation film (i.e., the upper electrode). If the PSG film 4 does not overlap the insulating layer at this time, the lower electrode and the upper electrode may contact each other and short-circuit when the PSG film is etched and dried in a later step.

Figure 4:
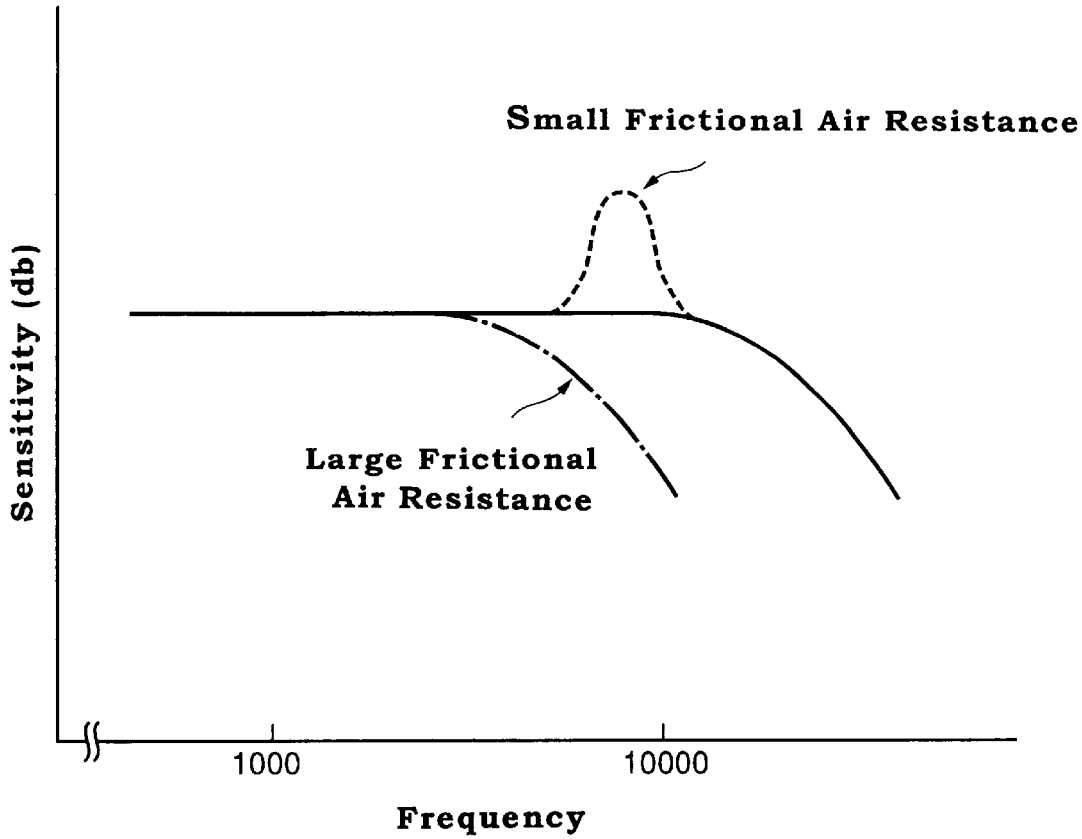
FIG. 4 is a chart illustrating a sensitivity—frequency characteristic when a frictional air resistance changes.

Subsequently, as shown in FIGS. 2(*c*) and (*c*'), the polysilicon film 3 was deposited to a thickness of about 1 to about 3 μm on the entire surface of the resulting silicon substrate 1 using a gas of $SiH_4$ at a deposition temperature of about 550 to about 700° C. Further, the polysilicon film 3 was doped with phosphorus for enhancing its conductivity using a gas of $POCl_3$ at a doping temperature of about 850 to about 950° C. Thereby the sheet resistance of the polysilicon film 3 became about several $\Omega.cm^{-2}$ to about several tens $\Omega.cm^{-2}$. Subsequently, the polysilicon film 3 was patterned in a desired shape by photo-etching to form the upper electrode having a support portion 3*b* and an oscillation portion 3*c*. The shape of the oscillation portion 3*c* was an equilateral octagon having an area of about $2.5\times10^5$ to $14.4\times10^5$ μm, for example. The shape of the support portion 3*b* was a rectangle whose longer side agreed with one side of the oscillation portion 3*c*. The support portions 3*b* were located at every other side of the oscillation portion 3*c*. Furthermore, sixty to ninety small holes 3*a* of about 6 to about 10 μm diameter were formed in the polysilicon film 3 existing on the PSG film 4. These small holes 3*a* were for rapid etching of the PSG film 4 in a later step. Also, by forming the small holes 3*a*, it was possible to optimize the frictional air resistance between the upper electrode and the lower electrode, thereby flattening an acoustic characteristic and improving the sensitivity to a high-pitched sound (high frequency) range, as shown in FIG. 4.

Further, as shown in FIGS. 2(*d*) and 2(*d*'), terminals was formed of Au/TiW films 5 (about 2 to about 4 μm/about 0.2 to about 0.3 μm thick) for taking signals from the lower electrode and the upper electrode. Here, the Au film was used for preventing the terminals from being etched by a HF etchant when the PSG film 4 is etched using the HF etchant in a later step, and the TiW film was formed before the formation of the Au film for preventing Au from diffusing into the lower electrode and the upper electrode.

Subsequently, as shown in FIGS. 2(*e*) and 2(*e*'), the resulting silicon substrate 1 was immersed in a 5 to 10% HF etchant for several hours and dried by IPA(isopropyl alchol) replacement so that the PSG film 4 was removed by etching to form the cavity 4*a*.

Figure 5:
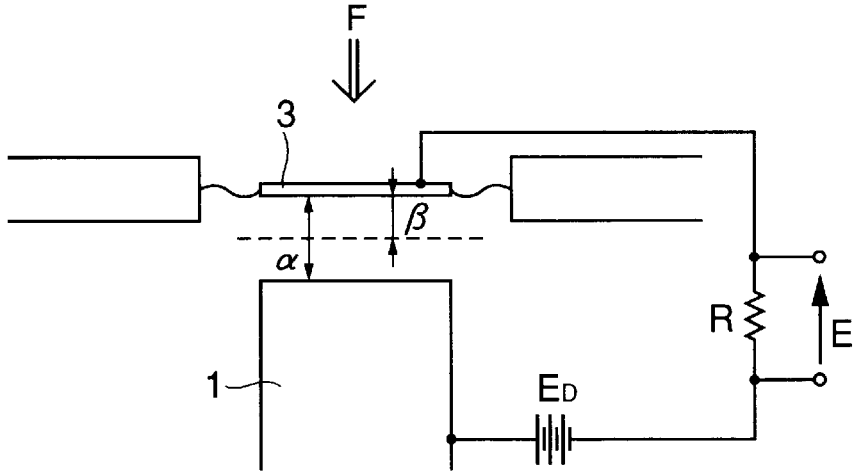
FIG. 5 is a diagram illustrating an operational principle of an electroacoustic transducer in accordance with the present invention.

Now explanation is given to the operational principle of the above-described electroacoustic transducer with reference to FIG. 5.

Voltage $E_D$ (e.g., DC about 3 to about 6 V) is applied to the upper electrode 3 and the lower electrode 1. When oscillation F corresponding to a sound is applied from the outside, the upper electrode 3 as an oscillation film is oscillated and the distance from the upper electrode 3 to the lower electrode 1 changes (as indicated by α, β and the like in FIG. 5). Thereby the electrostatic capacity between the electrode 1 and 3 is changed and the amount of electric charge changes. Further, electric current flows with the change of the amount of electric charge. This electric current flows through a resistance R (e.g., about 1 to about 3 KΩ), and thereby voltage E corresponding to the sound is output.

Second Embodiment

Figure 6:
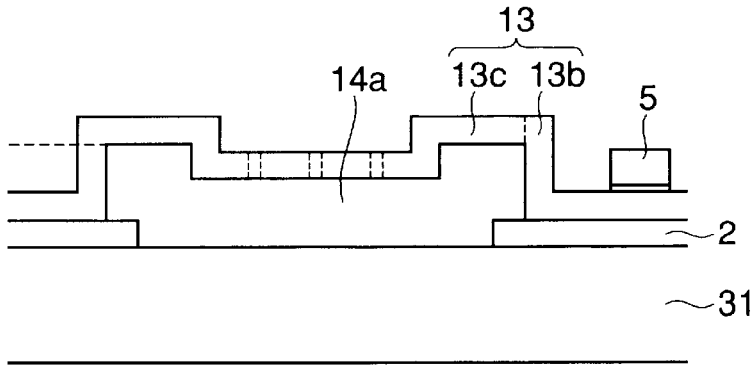
FIG. 6 is a schematic sectional view of a major part illustrating a second embodiment of an electroacoustic transducer in accordance with the present invention.

As shown in FIG. 6, an electroacoustic transducer in this embodiment is substantially the same as the electroacoustic transducer in FIG. 1 except that in a polysilicon film 13 forming the upper electrode, the bottom face of an oscillation portion 13*c* (a part of the upper electrode immediately above a cavity 14*a*) is above the top face of a support portion 13*b* extended immediately above an insulating layer of a SiN film 2.

Third Embodiment

Figure 7:
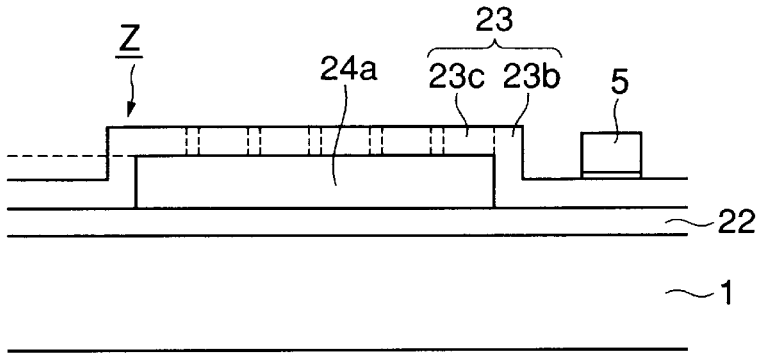
FIG. 7 is a schematic sectional view of a major part illustrating a third embodiment of an electroacoustic transducer in accordance with the present invention.

As shown in FIG. 7, an electroacoustic transducer in this embodiment is substantially the same as the electroacoustic transducer in FIG. 1 except that an insulating layer of an SiN film 22 covers the entire surface of a silicon substrate 1 serving as a lower electrode and consequently an upper electrode has an up and down Z only at a support portion 23*b*.

In this electroacoustic transducer, since the insulating layer covers the entire surface of the lower electrode, the electroacoustic transducer can prevent short circuit between the upper electrode and the lower electrode even if a sudden large sound gives oscillation when the electroacoustic transducer is used as an electroacoustic transducer. Accordingly, it is possible to avoid damage to or breakdown of the electroacoustic transducer itself.

Fourth Embodiment

Figure 8:
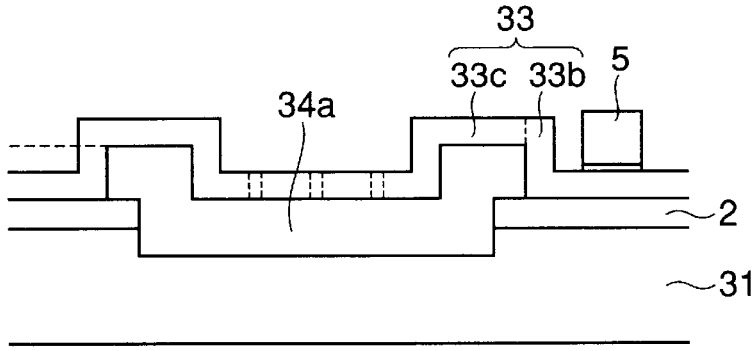
FIG. 8 is a schematic sectional view of a major part illustrating a forth embodiment of an electroacoustic transducer in accordance with the present invention.

As shown in FIG. 8, an electroacoustic transducer in this embodiment is substantially the same as the electroacoustic transducer in FIG. 1 except that a concave is formed in a surface of a silicon substrate 31 where the insulating layer of a SiN film 2 does not exist and consequently the surface of an oscillation portion 33*c* sinks by the depth of the concave.

This electroacoustic transducer can be produced by substantially the same production process as that in the first embodiment except that in FIGS. 2(*a*) and 2(*a*'), the silicon substrate 1 is removed by etching by about 0.5 to about 2.0 μm when the SiN film 2 is patterned by photo-etching and then in FIGS. 2(*b*) and 2(*b*'), ions are implanted at the bottom of the concave and the PSG film 4 is formed on the entire surface of the silicon substrate 1 including the concave.

Fifth Embodiment

Figure 9:
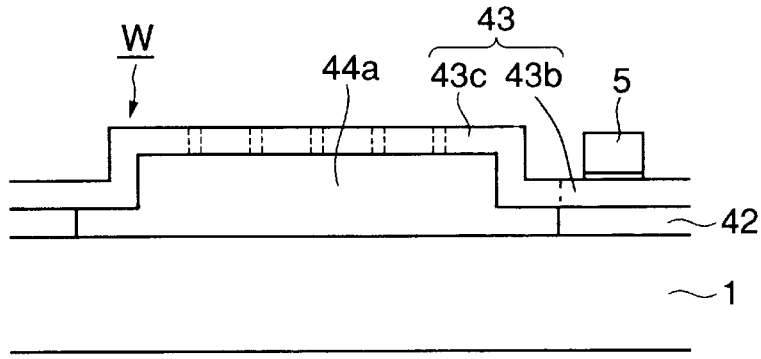
FIG. 9 is a schematic sectional view of a major part illustrating a fifth embodiment of an electroacoustic transducer in accordance with the present invention.

As shown in FIG. 9, an electroacoustic transducer in this embodiment is substantially the same as the electroacoustic transducer in FIG. 1 except that an insulating layer of a SiN film 42 contacts a support portion 43*b* of an upper electrode, an up and down is not formed in the support portion 43*b* and an oscillation portion 43*c* has an up and down formed on its top and bottom faces near the edge of the insulating layer by bending.

Sixth Embodiment

Figure 10:
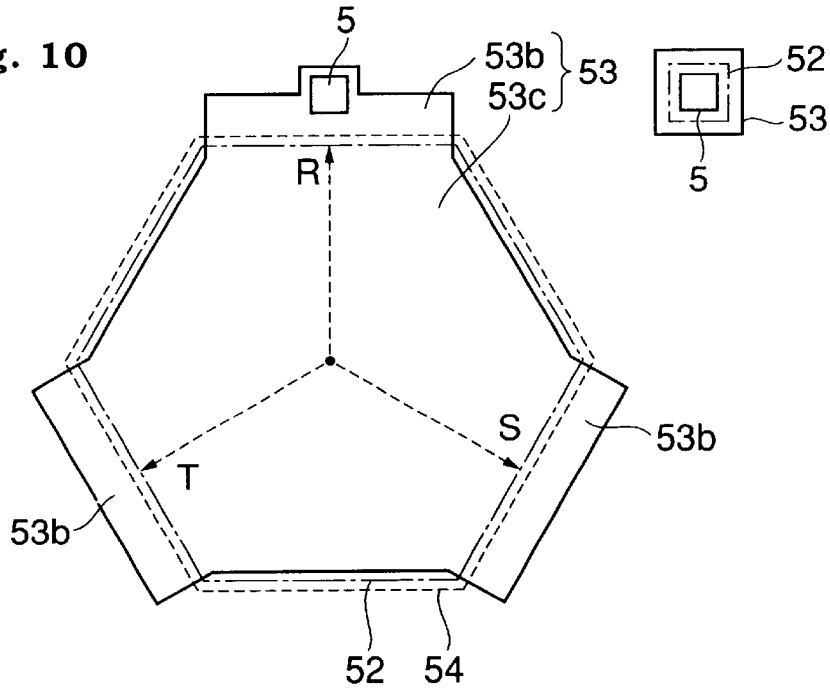
FIG. 10 is a schematic plan view of a major part illustrating a sixth embodiment of an electroacoustic transducer in accordance with the present invention.

As shown in FIG. 10, an electroacoustic transducer in this embodiment is substantially the same as the electroacoustic transducer in FIG. 1 except that an upper electrode of a polysilicon film 53 has an oscillation portion 53*c* in the shape of a substantially equilateral hexagon and three support portions 53*b* extended from three places on the periphery of the oscillation portion 53*c*.

Distances R, S and T from the center of the oscillation portion 53*c* to the support portions 53*b* are the same.

The support of the oscillation portion 53*c* by the three support portions 53*b* maintains the oscillation portion 53*c* with stronger tension and therefore enhances the sensitivity to oscillation generated by sound.

Seventh Embodiment

Figure 11:
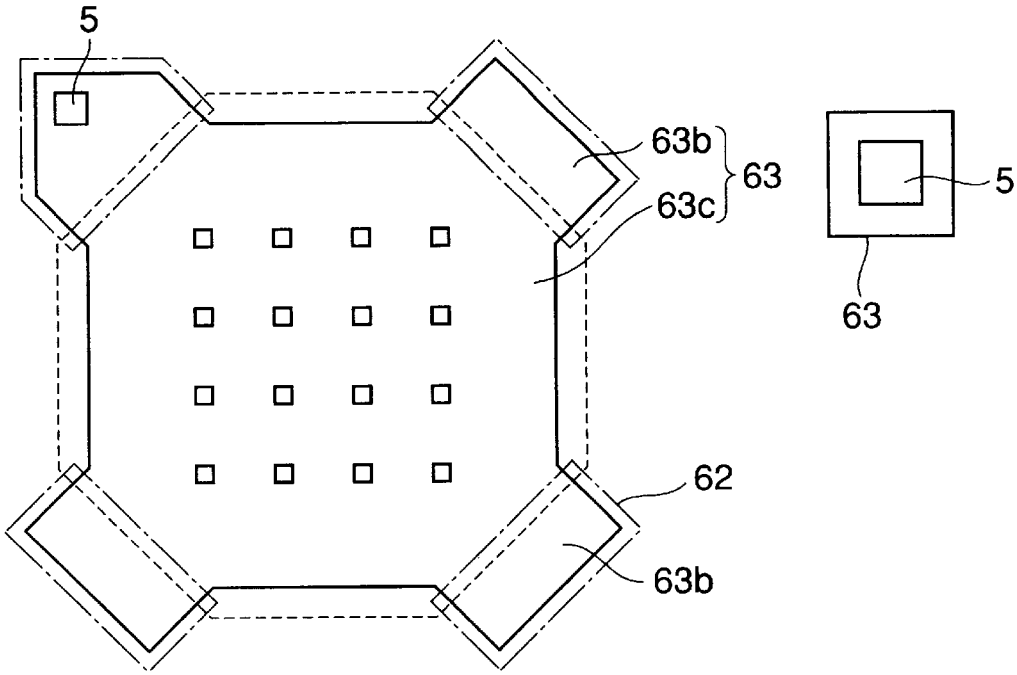
FIG. 11 is a schematic plan view of a major part illustrating a seventh embodiment of an electroacoustic transducer in accordance with the present invention.

As shown in FIG. 11, an electroacoustic transducer in this embodiment is substantially the same as the electroacoustic transducer in FIG. 1 except that an insulating layer 62 is disposed almost right under support portions 63*b* alone.

By disposing the insulating layer 62 only just under the support portions 63*b*, it is possible to form an n-type diffusion layer continuously from under an oscillation portion 63*c* to under a terminal for connection of a lower electrode by ion implantation in FIGS. 2(*b*) and 2(*b*') using the insulating layer as a mask in the production process of the electroacoustic transducer. Therefore the resistance of the lower electrode can be reduced.

Eighth Embodiment

Figure 12A:
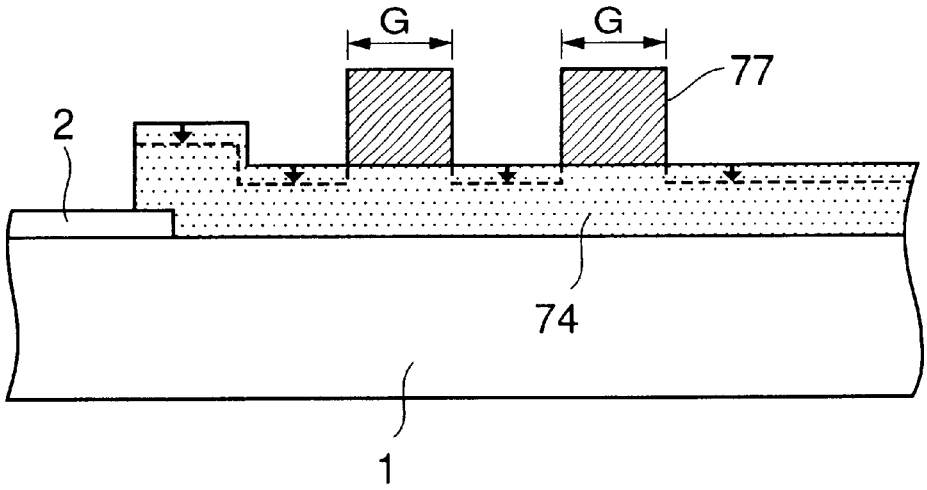
FIGS. 12(*a*) and 12(*b*) are schematic sectional views of a major part illustrating an eighth embodiment of an electroacoustic transducer in accordance with the present invention.
Figure 12B:
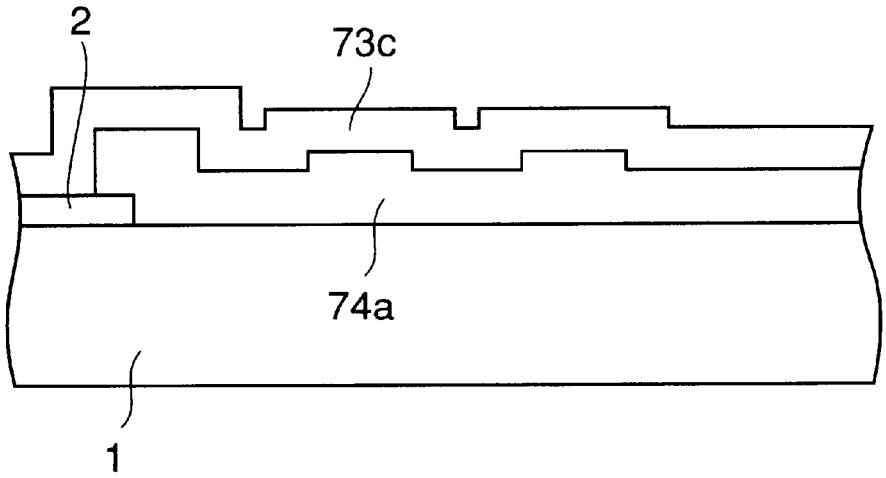

As shown in FIG. 12(*b*), an electroacoustic transducer in this embodiment is substantially the same as the electroacoustic transducer in FIG. 1 except that an oscillation portion 73*c* of an upper electrode made of a polysilicon film has a plurality of projections and depressions in its periphery.

This electroacoustic transducer can be produced by substantially the same production process as that in the first embodiment except that, after a PSG film 74 is deposited (to a thickness of about 2.0 μm) and patterned in a desired pattern in FIGS. 2(*b*) and 2(*b*'), a photo-mask 77 having a line width G (about 10 to 20 μm) is formed in the periphery of the PSG film 74 as shown in FIG. 12(*a*), the PSG film 74 is etched about 0.3 to 1.0 μm using the photo-mask 77 by immersion in a HF etchant for about two minutes so as to form a plurality of projections and depressions in the surface of the periphery of the PSG film 74.

Ninth Embodiment

Figure 13:
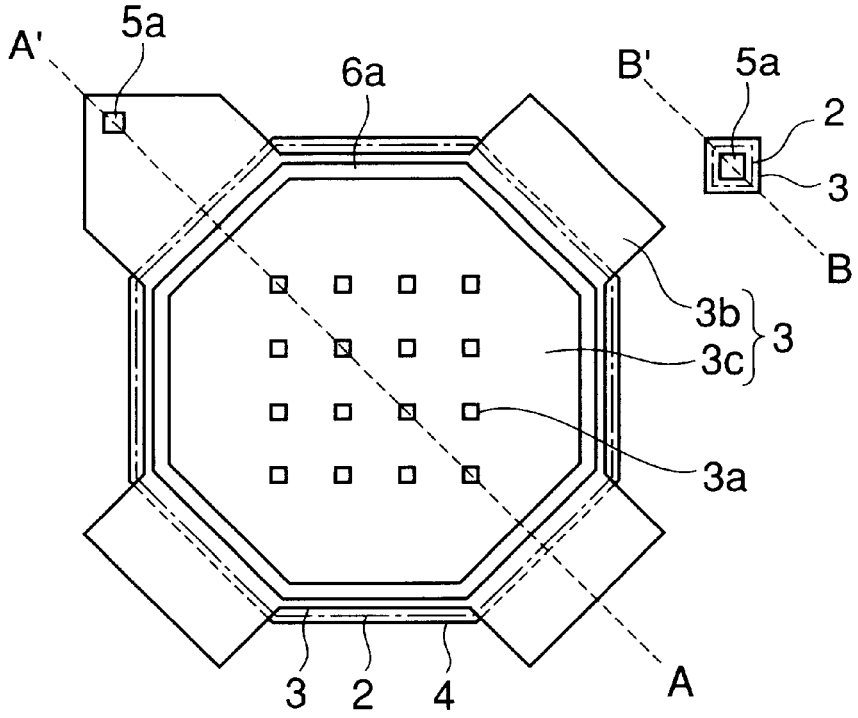
FIGS. 13(*a*) and 13(*b*) are a schematic plan view and a schematic sectional view, respectively, of a major part illustrating a ninth embodiment of an electroacoustic transducer in accordance with the present invention.
Figure 13B:
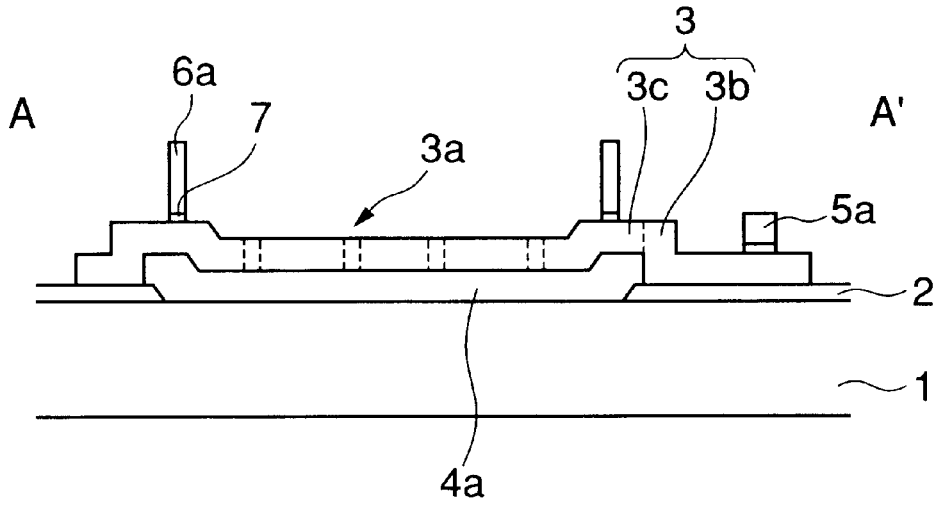
Figure 14A:
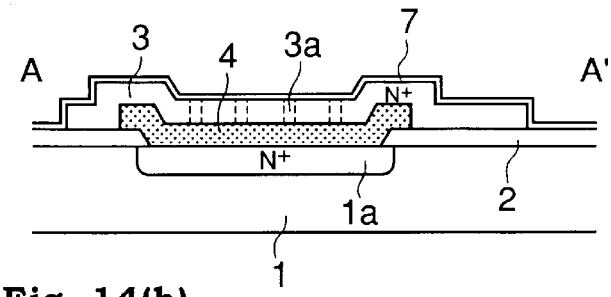
FIGS. 14(*a*) to 14(*e*) and 14(*a'*) to 14(*e'*) are schematic sectional views of a major part illustrating a process of producing the electroacoustic transducer shown in FIGS. 13(*a*) and 13(*b*)
Figure 14A:
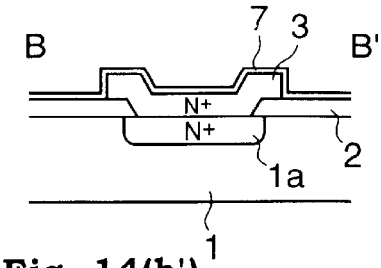
Figure 14B:
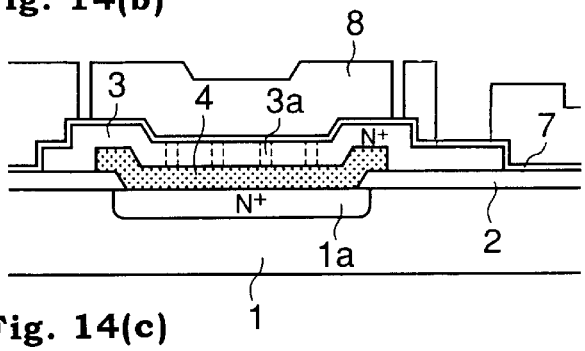
Figure 14B:
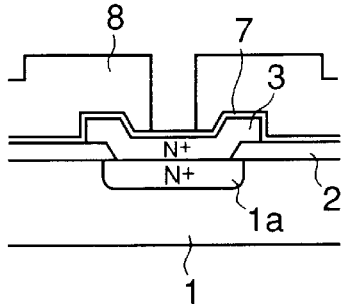
Figure 14C:
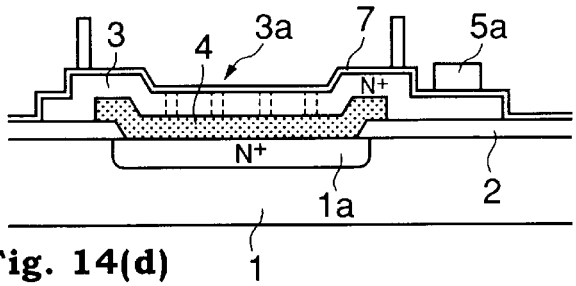
Figure 14C:
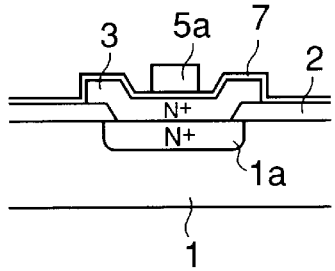
Figure 14D:
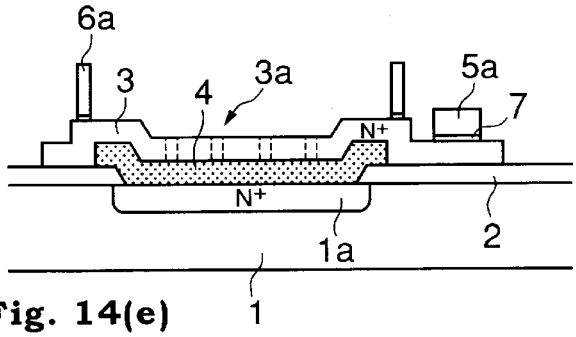
Figure 14D:
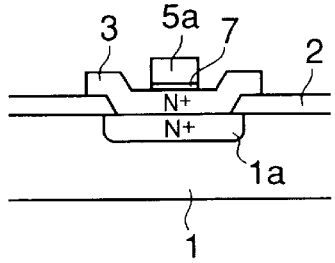
Figure 14E:
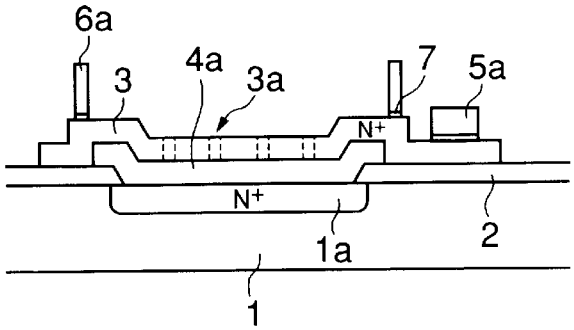
Figure 14E:
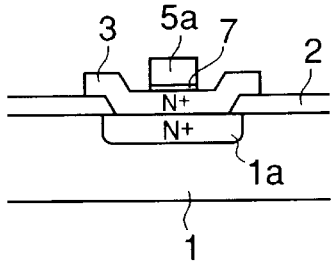

As shown in FIGS. 13(*a*) and 13(*b*), an electroacoustic transducer in this embodiment is substantially the same as the electroacoustic transducer in FIG. 1 except that an oscillation portion 3*c* of an upper electrode made of a polysilicon film 3 is all surrounded by a belt-form wall 6*a*.

The wall 6*a* was formed of a Au-plated film of 18 μm height and 40 μm width.

This electroacoustic transducer was produced by the following production process:

After the steps up to FIGS. 2(*c*) and 2(*c*') in the first embodiment, an Au/TiW film 7 was formed to about 0.05 to 0.2 μm/0.1 to 0.4 μm thickness on the entire surface of the resulting silicon substrate 1 as shown in FIGS. 14(*a*) and 14(*a*').

Subsequently, as shown in FIGS. 14(*b*) and 14(*b*'), a resist film was formed to about 10 to 30 μm thickness on the entire surface of the Au/TiW film 7 and openings were formed in regions where the walls 6*a* and a terminal for taking out signals were to be formed, thereby forming a resist pattern 8.

Thereafter, as shown in FIGS. 14(*c*) and 14(*c*'), the Au-plated film was deposited using a Au plating solution, and then the resist pattern 8 was removed.

Subsequently, as shown in FIGS. 14(*d*) and 14(*d*'), the Au/TiW film 7 was etched using the Au-plated film as a mask to form the wall 6*a* and the signal take-out terminal 5*a*.

Thereafter, as shown in FIGS. 14(*e*) and 14(*e*'), the resulting silicon substrate 1 was immersed in a 5 to 10% HF etchant for several hours and dried by IPA replacement so that the PSG film 4 was removed by etching to form a cavity 4*a*.

Tenth embodiment

Figure 15A:
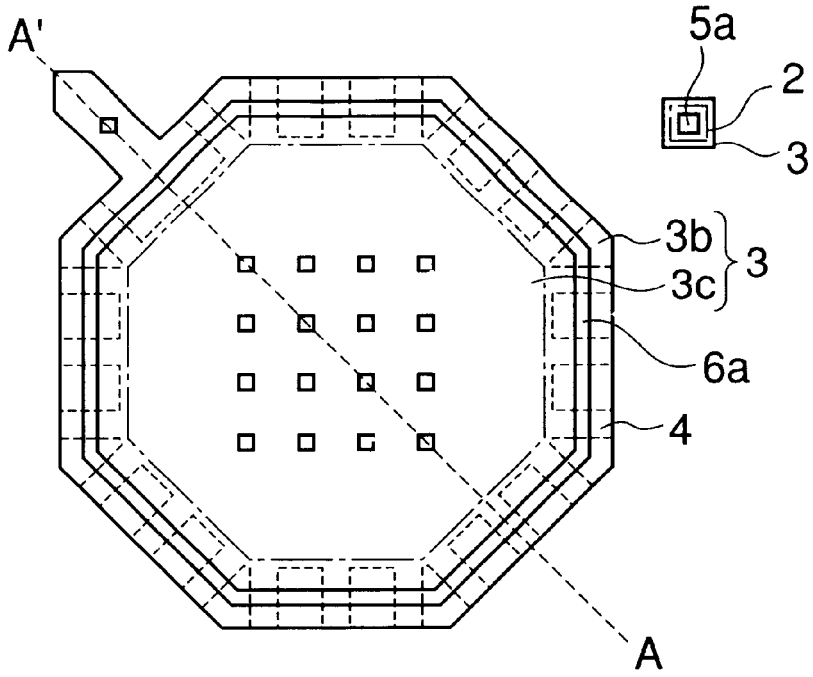
FIGS. 15(*a*) and 15(*b*) are a schematic plan view and a schematic sectional view, respectively, of a major part illustrating a tenth embodiment of an electroacoustic transducer in accordance with the present invention.
Figure 15B:
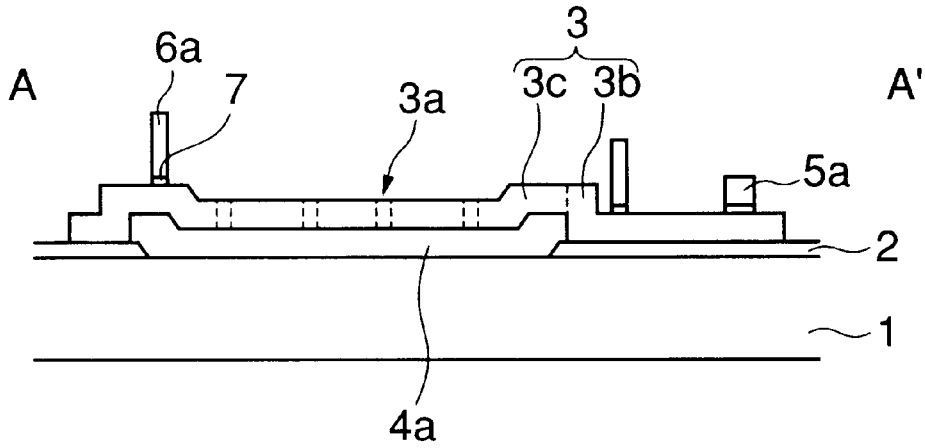

As shown in FIGS. 15(*a*) and 15(*b*), an electroacoustic transducer in this embodiment is substantially the same as the electroacoustic transducer in FIG. 1 except that the device has such a wall 6*a* as described in the ninth embodiment in all the periphery of support portions 3*b* of an upper electrode made of a polysilicon film 3.

Figure 16A:
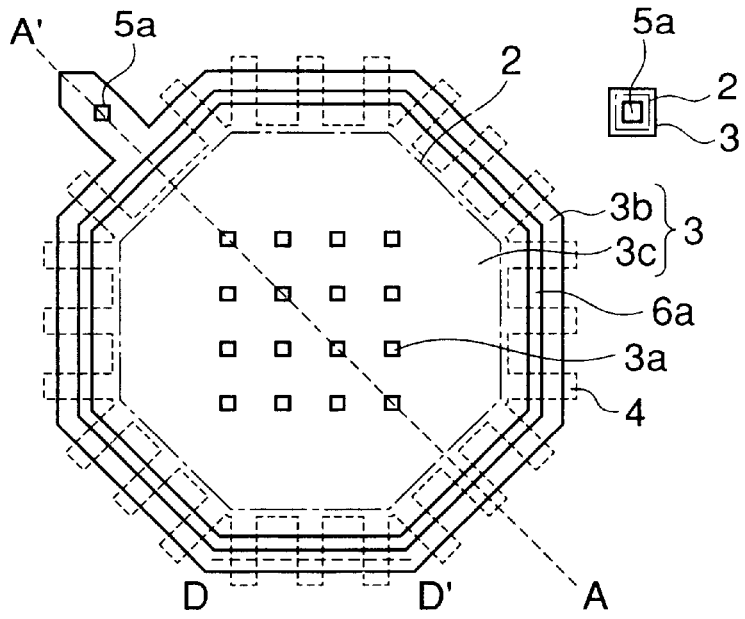
FIGS. 16(*a*), 16(*b*) and 16(*c*) are a schematic plan view and schematic sectional views of a major part illustrating a process of producing a the electroacoustic transducer shown in FIGS. 15(*a*) and 15(*b*)
Figure 16B:
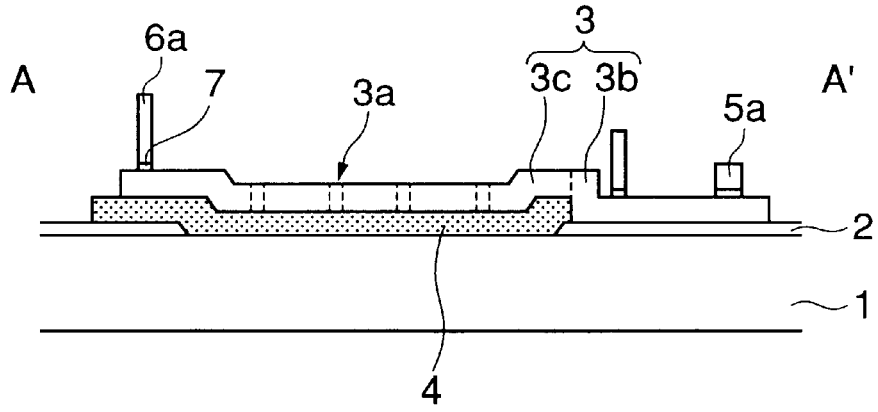
Figure 16C:
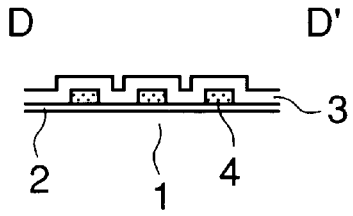

It is noted that FIGS. 15(*a*) and 15(*b*) show the electroacoustic transducer after the PSG film 4*a* is removed by etching and that FIGS. 16(*a*) to 16(*c*) show the electroacoustic transducer before the PSG film 4*a* is etched in the production process.

This electroacoustic transducer can be produced by the same production process as that of the ninth embodiment.

Eleventh Embodiment

Figure 17A:
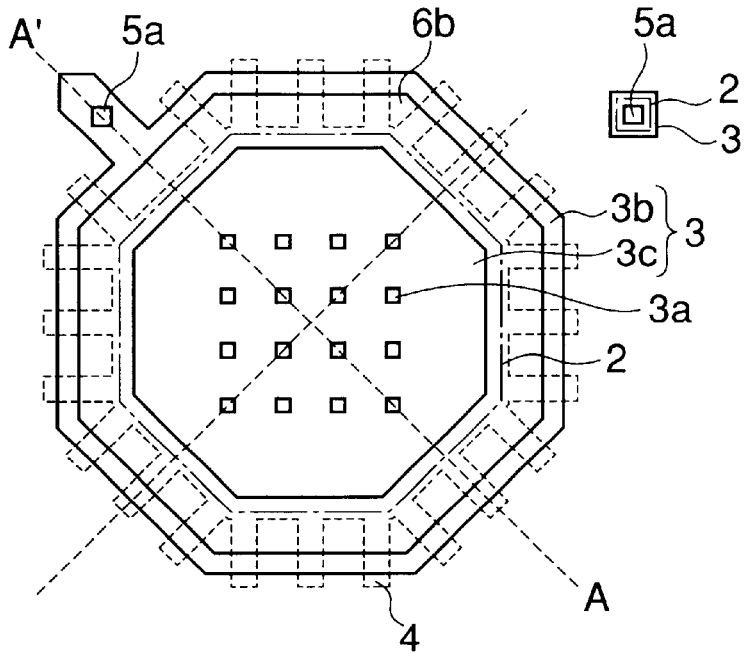
FIGS. 17(*a*), 17(*b*) and 17(*c*) are a schematic plan view and schematic sectional views of a major part illustrating an eleventh embodiment of an electroacoustic transducer in accordance with the present invention.
Figure 17B:
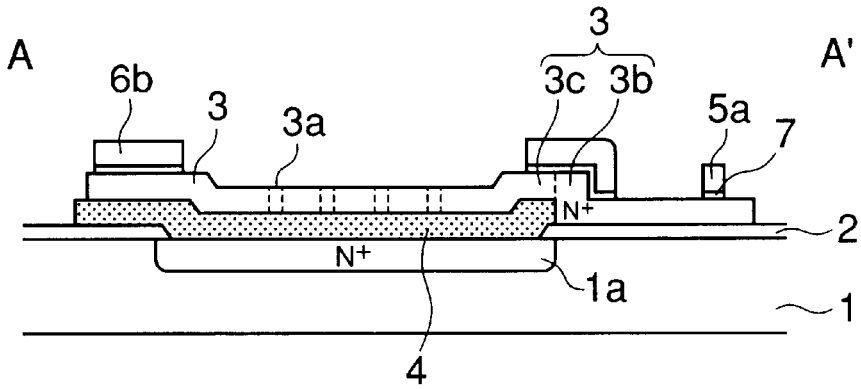
Figure 17C:
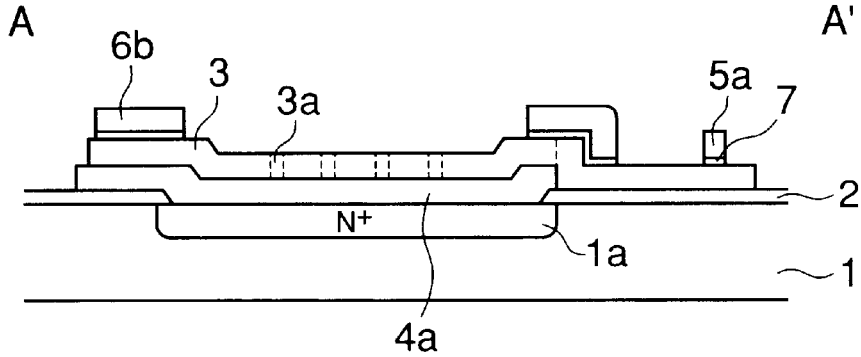
Figure 18A:
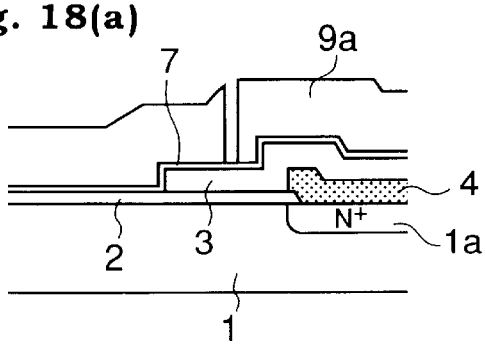
FIGS. 18(*a*) to 18(*g*) are schematic sectional views of a major part illustrating a process of producing a twelfth embodiment of an electroacoustic transducer in accordance with the present invention.
Figure 18B:
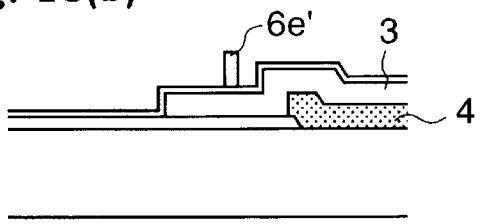
Figure 18C:
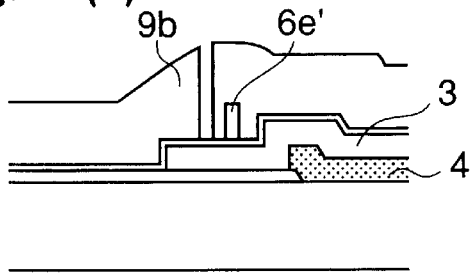
Figure 18D:
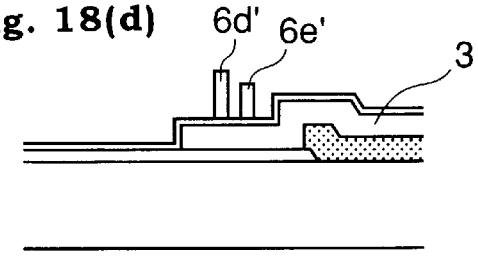
Figure 18E:
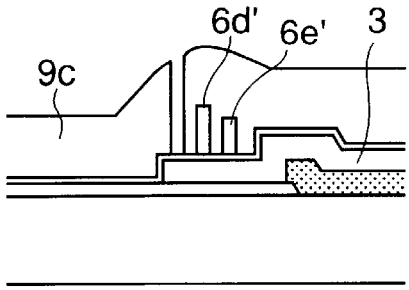
Figure 18F:
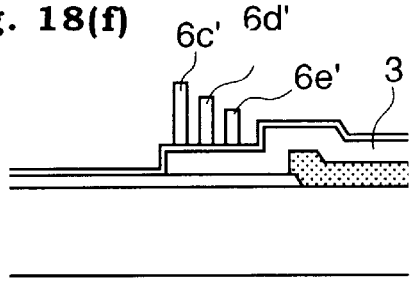
Figure 18G:
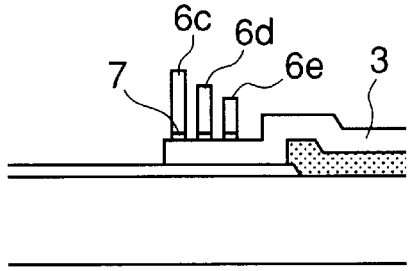

As shown in FIGS. 17(*a*) and 17(*c*), an electroacoustic transducer in this embodiment is substantially the same as the electroacoustic transducer in FIG. 1 except that the device has a wall 6*b* in all the periphery of a region extending over an oscillation portion 3*c* and support portion 3*b* of an upper electrode formed of a polysilicon film 3. The wall 6*b* is formed of a Au-plated film of 18 μm height and 60 μm width.

It is noted that FIGS. 17(*a*) and 17(*c*) show the electroacoustic transducer after the PSG film 4*a* is removed by etching and that FIG. 17(*b*) shows the electroacoustic transducer before the PSG film 4*a* is etched in the production process.

Twelfth Embodiment

As shown in FIG. 18(*g*), an electroacoustic transducer in this embodiment is substantially the same as the electroacoustic transducer in FIG. 1 except that three walls 6*c*, 6*d* and 6*e* are formed of gold bumps at the periphery of support portions of an upper electrode formed of a polysilicon film 3. In these walls 6*c*, 6*d* and 6*e*, one closer to the center of an oscillation portion has a smaller height than another. The walls 6*c*, 6*d* and 6*e* are 18 μm high and 30 μm wide, 12 μm high and 30 μm wide, and 6 μm high and 30 μm wide, respectively. They are disposed at intervals of 20 μm.

The highest wall 6*c* can improve directivity, the other walls 6*d* and 6*e* can improve the sound collecting effect.

This electroacoustic transducer can be produced by the following production process:

After the steps up to FIGS. 14(*a*) and 14(*a*') in the ninth embodiment, a resist is applied in about 25 μm thickness on the entire surface of the Au/TiW film 7 and openings are formed in regions where the walls 6*e* and a terminal for taking out signals are to be formed, thereby forming a resist pattern 9*a*, as shown in FIGS. 18(*a*) and 18(*a*').

Thereafter, as shown in FIGS. 18(*b*) and 18(*b*'), a Au-plated film 6*e*' is deposited using a Au plating solution, and then the resist pattern 9*a* is removed.

Subsequently, as shown in FIGS. 18(*c*) and 18(*c*'), a resist is applied as described above and openings are formed in regions where the walls 6*d* are to be formed, thereby forming a resist pattern 9*b*.

Thereafter, as shown in FIGS. 18(*d*) and 18(*d*'), a Au-plated film 6*d*' is deposited using a Au plating solution, and then the resist pattern 9*b* is removed.

Subsequently, as shown in FIGS. 18(*e*) and 18(*e*'), a resist is applied as described above and openings are formed in regions where the walls 6*c* are to be formed, thereby forming a resist pattern 9*c*.

Thereafter, as shown in FIGS. 18(*f*) and 18(*f*'), a Au-plated film 6*c*' is deposited using a Au plating solution, and then the resist pattern 9*c* is removed.

Subsequently, as shown in FIGS. 18(*g*) and 18(*g*'), the Au/TiW film 7 is etched using the Au-plated films 6*c*', 6*d*' and 6*e*' as masks to form the walls 6*c*, 6*d* and 6*e* and the signal take-out terminal 5*a* (not shown).

Thereafter, a cavity 4*a* is formed by etching the PSG film 4 in the same manner as in the first embodiment.

Thirteenth Embodiment

Figure 19:
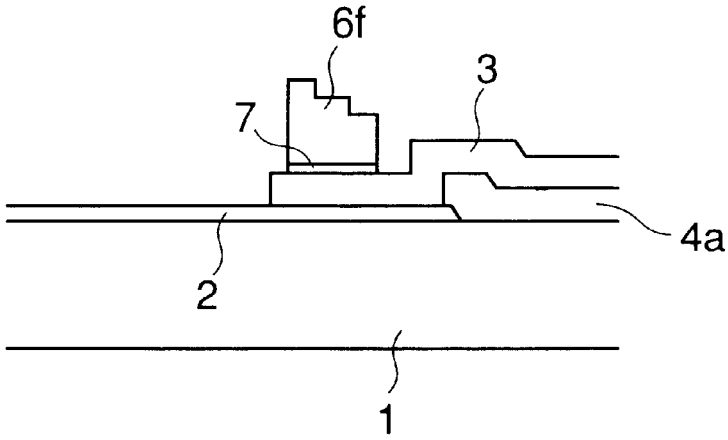
FIG. 19 is a schematic sectional view of a major part illustrating a thirteenth embodiment of an electroacoustic transducer in accordance with the present invention.

As shown in FIG. 19, an electroacoustic transducer in this embodiment is substantially the same as the electroacoustic transducer in FIG. 18(*g*) except that a wall 6*f* having steps on its top face is formed in all the periphery of support portions 3*b* of an upper electrode formed of a polysilicon film 3. The wall 6*f* is 18 μm, 12 μm and 6 μm high and 90 μm wide.

This electroacoustic transducer can be produced by the same production process as that of the twelfth embodiment.

Fourteenth Embodiment

Figure 20A:
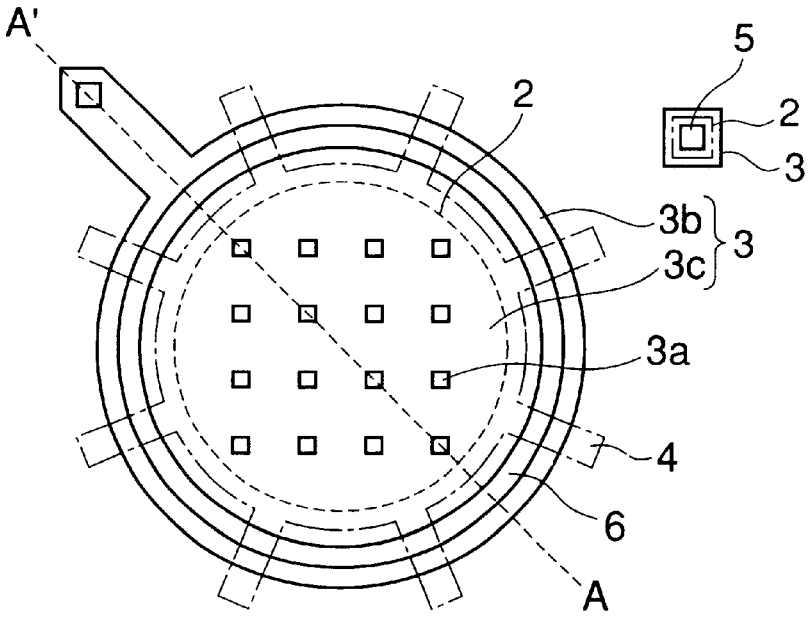
FIGS. 20(*a*) and 20(*b*) are a schematic plan view and a schematic sectional view, respectively, of a major part illustrating a fourteenth embodiment of an electroacoustic transducer in accordance with the present invention.
Figure 20B:
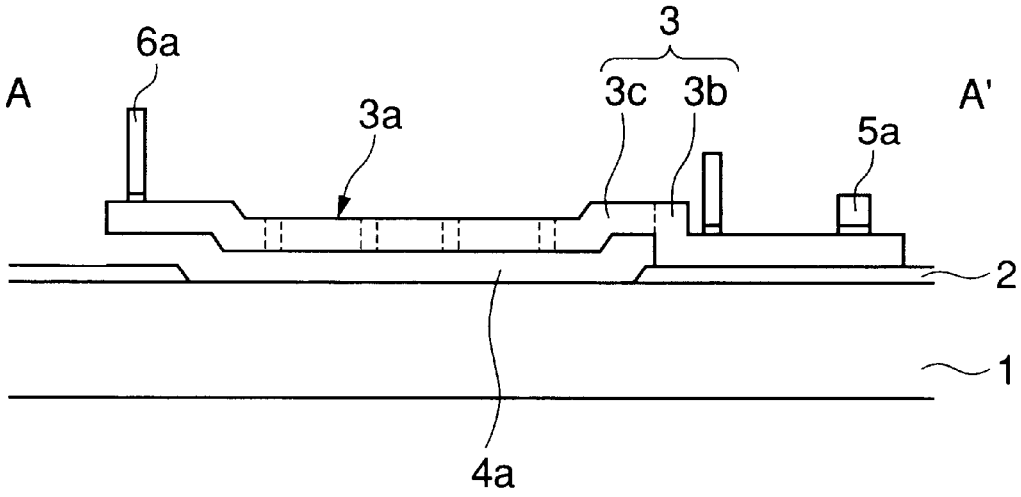
Figure 21A:
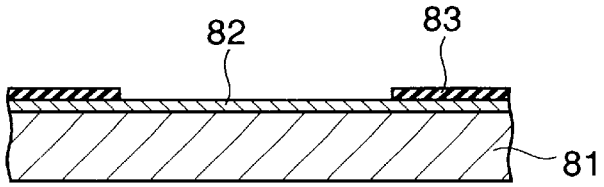
Fig. 21(a) (Prior Art)
FIGS. 21(*a*) to 21(*e*) are schematic sectional views of a major of a conventional electroacoustic transducer.
Figure 21B:
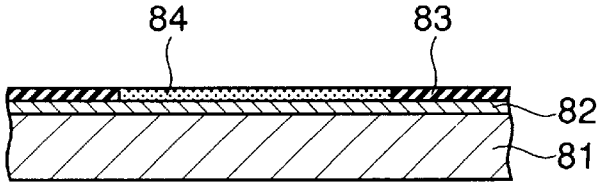
Fig. 21(b) (Prior Art)
Figure 21C:
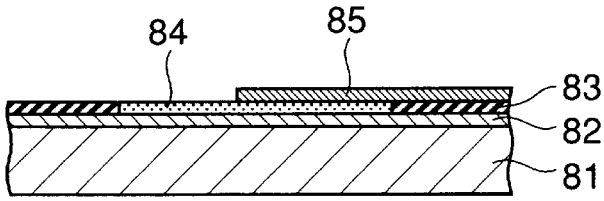
Fig. 21(c) (Prior Art)
Figure 21D:
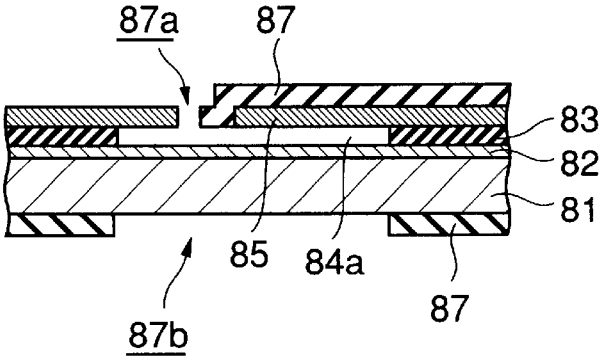
Fig. 21(d) (Prior Art)
Figure 21E:
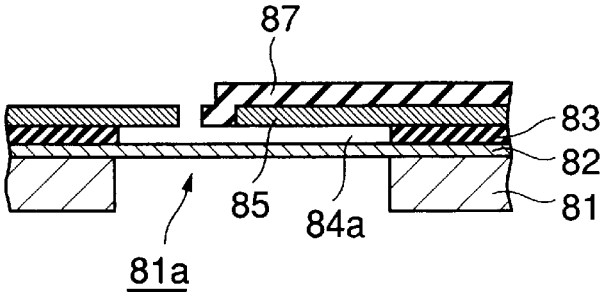
Fig. 21(e) (Prior Art)
Figure 22:
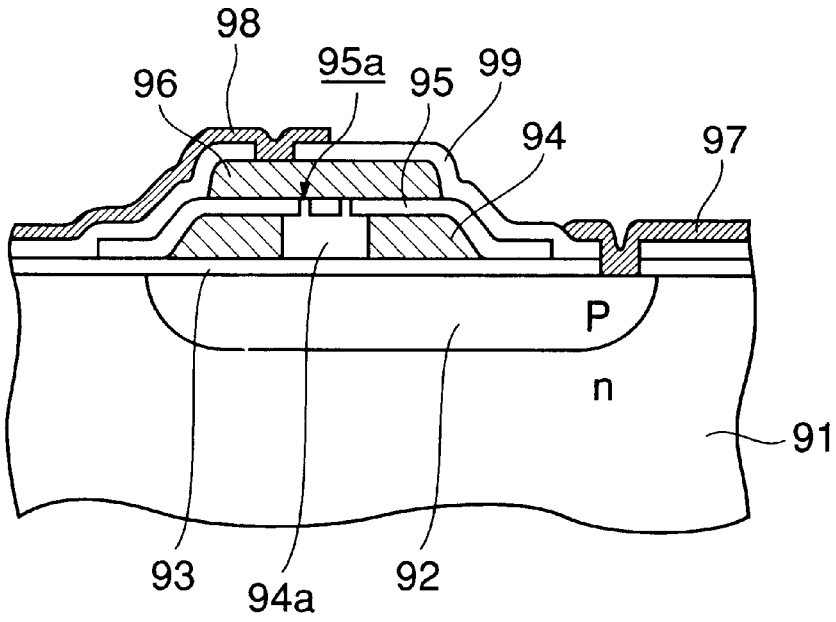
Fig. 22 (Prior Art)
FIG. 22 is a schematic sectional of a major part of a conventional pressure sensor.

As shown in FIG. 20, an electroacoustic transducer in this embodiment is substantially the same as the electroacoustic transducer in FIG. 13(*a*) except that an oscillation portion 3*c* of an upper electrode formed of a polysilicon film 3 is almost circular and a wall 6*a* is formed in all the periphery of a support portion 3*b*.

Fifteenth Embodiment

An electric signal—acoustic signal conversion apparatus can be produced with use of a number of electroacoustic transducers as produced in the first to fourteenth embodiments.

Examples of such electric signal—acoustic signal conversion apparatus include an electric signal—acoustic signal conversion apparatus provided with two or three or more electroacoustic transducers without the walls, an electric signal—acoustic signal conversion apparatus provided with two or three or more electroacoustic transducers with the walls, and an electric signal—acoustic signal conversion apparatus provided with one or two or more electroacoustic transducers without the walls and one or two or more electroacoustic transducers with the walls.

According to the electroacoustic transducer of the present invention, the thickness of the upper electrode, which is one electrode of the capacitor, can be controlled with ease, and also the upper electrode maintains an appropriate tension by having the up and down, so that the upper electrode can be prevented from short-circuiting with the lower electrode. Therefore, it is possible to obtain a highly reliable electroacoustic transducer having good acoustic characteristics.

In the case where the bottom face of the end part of the oscillation portion is situated above the top face of the support portion extended right above the insulating layer, the tension of the upper electrode can be improved further, which leads to good acoustic characteristics.

In the case where the bottom face of the end part of the oscillation portion is situated below or at the same level as the top face of the support portion extended right above the insulating layer, the volume of the cavity is reduced. Accordingly the output voltage can be raised if the same oscillation is given. Therefore, it is possible to obtain an electroacoustic transducer having better sensitivity.

In the case where the oscillation portion has, in its peripheral region, a plurality of faces having different distances from the lower electrode, the upper electrode can maintain better tension, which leads to further improvement of the acoustic characteristics.

In the case where the oscillation portion has at least one small hole, the frictional air resistance between the upper and lower electrodes can be optimized. Therefore, it is possible to flatten the acoustic characteristics and improve the sensitivity to high-pitched tones.

In the case where the support portion supports the oscillation portion at three places equidistant from the center of the oscillation portion, the tension of the upper electrode can be improved further.

In the case where the oscillation portion is substantially circular or substantially equilateral polygonal, a sound can be transmitted uniformly to the oscillation portion, and therefore the sound sensitivity can be enhanced in addition to further improvement of the tension. It is possible to improve the sound effect further.

In the case where the lower electrode is formed of a semiconductor substrate, high integration and combination with others semiconductor devices becomes easier.

In the case where the upper and lower electrodes are connected to terminals formed of gold bumps for applying voltage, it is possible to prevent oxidization and corrosion by an etchant during the production process and by air and humidity after production. Accordingly, an additional protective film need not be formed. Therefore, it is possible to improve the oscillation of the upper electrode in response to an input voice and also provide a highly reliable electroacoustic transducer.

In the case where the conversion device is provided with a wall in the periphery of the oscillation portion of the upper electrode, noise from the surroundings of the upper electrode can be cut, and the directivity to an input voice can be improved, which leads to further improvement of the oscillation of the upper electrode in response to the input voice. In the case where the support portion is surrounded by the wall, the oscillation efficiency loss can be prevented from being generated in changes in the thickness of the oscillation portion, which leads to further improvement of the oscillation of the upper electrode in response to the input voice. In the case where the wall is provided in the peripheral region extending over the oscillation portion and the support portion, the area of the support portion of the upper electrode can be reduced without decreasing the strength of the wall. Therefore, it is possible to improve the capacity conversion efficiency owing to the reduction of the parasitic capacity, improve the oscillation efficiency and reduce the size.

In the case where the upper electrode is provided with a plurality of walls, where the upper electrode is provided with a plurality of walls whose heights decrease as the walls are closer to the center of the oscillation portion, and/or where the upper electrode is provided with a wall having a top face whose height decreases toward the center of the oscillation portion, the directivity and the sound collecting effect can be further improved.

Further, according to the process of producing the electroacoustic transducer of the present invention, a highly reliable high-performance electroacoustic transducer can be produced by a simplified process.

It is also possible to produce a high-quality electroacoustic transducer with an improved tension in the upper electrode by a simple process of adding one resist mask only.

In the case where the upper electrode has small holes, the time required for etching the sacrificial film can be reduced, which simplifies the production process and leads to the reduction in production costs.

In the case where the sacrificial film is formed of a silicon oxide film doped with phosphorus, the simplification of the production process and the reduction of production costs can be facilitated more.

What is claimed is:

1. An electroacoustic transducer comprising:

a lower electrode comprising a semiconductor substrate;

an upper electrode, at least partially supported by the semiconductor substrate of the lower electrode, the upper electrode including an oscillation portion and a support portion for supporting the oscillation portion at least at a part of a periphery of the oscillation portion, wherein said oscillation portion of the upper electrode oscillates upon receiving an acoustical signal sufficiently so as to change a distance between the upper and lower electrodes thereby changing a capacitance of a capacitor formed thereby so that an electrical signal indicative of the acoustical signal is generated; and an insulating layer for insulating the lower electrode from the upper electrode, wherein the upper electrode has an up and down portion (s) in the oscillation portion and/or in the support portion to provide a cavity which is located directly between the upper electrode and the semiconductor substrate of the lower electrode, and wherein the cavity is in air communication with atmosphere/air exterior the transducer so that air can move therebetween, and wherein the lower electrode completely seals off a lower side of the cavity.

2. An electroacoustic transducer according to claim 1, wherein the upper electrode has the up and down at least on a top face of the support portion.

3. An electroacoustic transducer according to claim 1, wherein the upper electrode has the up and down formed by the bending of the oscillation portion in the vicinity of an end part of the insulating layer.

4. An electroacoustic transducer according to claim 1, wherein a bottom face of an end part of the oscillation portion is higher than a top face of a region of the support portion extended immediately above the insulating layer.

5. An electroacoustic transducer according to claim 1, wherein a bottom face of an end part of the oscillation portion is lower than or at the same level as a top face of a region of the support portion extended immediately above the insulating layer.

6. An electroacoustic transducer according to claim 1, wherein the oscillation portion has, in its peripheral region, a plurality of faces having different distances from the lower electrode by bending.

7. An electroacoustic transducer according to claim 1, wherein the oscillation portion has at least one small hole.

8. An electroacoustic transducer according to claim 1, wherein the support portion supports the oscillation portion at three places equidistant from the center of the oscillation portion.

9. An electroacoustic transducer according to claim 1, wherein the oscillation portion is substantially circular.

10. An electroacoustic transducer according to claim 1, wherein the oscillation portion is in the shape of a substantially equilateral polygon.

11. An electroacoustic transducer according to claim 1, wherein the upper electrode and the lower electrode are each connected to a terminal formed by a gold bump for applying voltage.

12. An electroacoustic transducer according to claim 1, which is provided with a wall in a periphery of the oscillation portion of the upper electrode.

13. An electroacoustic transducer according to any one of claims 12 to 15, wherein the upper electrode is provided with a plurality of walls.

14. An electroacoustic transducer according to claim 13, provided with a plurality of walls, wherein the nearer the walls are to the center of the oscillation portion, the shorter the walls are.

15. An electroacoustic transducer according to any one of claims 12 to 15, wherein the upper electrode is provided with a wall whose top face reduces its height toward the center of the oscillation portion.

16. An electroacoustic transducer according to claim 1, which is provided with a wall in a periphery of the support portion of the upper electrode.

17. An electroacoustic transducer according to claim 1, which is provided with a wall in a peripheral region extending over the oscillation portion and the support portion of the upper electrode.

18. An electroacoustic transducing device comprising a plurality of electroacoustic transducers as set forth in claim 1.

19. An electroacoustic transducer comprising:

a lower electrode comprising a semiconductor substrate;

an upper electrode, at least partially supported by the semiconductor substrate of the lower electrode and separated from the semiconductor substrate by at least one insulating layer, the upper electrode including an oscillation portion and a support portion for supporting the oscillation portion, wherein said oscillation portion of the upper electrode oscillates upon receiving an acoustical signal sufficiently so as to change a distance between the upper and lower electrodes thereby changing a capacitance of a capacitor formed thereby so that an electrical signal indicative of the acoustical signal is generated;

wherein the upper electrode comprises at least one protrusion and/or depression defined at an upper surface thereof; and wherein a cavity is located directly between the upper electrode and the semiconductor substrate of the lower electrode, and wherein the cavity is in air communication with atmosphere/air exterior the transducer, and wherein the semiconductor substrate completely seals off a lower side of the cavity.

20. The electroacoustic transducer of claim 19, wherein said upper electrode includes a plurality of apertures defined therein, and the cavity is in air communication with the atmosphere/air via said apertures.

21. An electroacoustic transducer according to claim 19, wherein the upper electrode has the protrusion/depression(s) at least on a top face of the support portion.

22. An electroacoustic transducer according to claim 19, wherein a bottom face of an end part of the oscillation portion is lower than or at the same level as a top face of a region of the support portion extended immediately above the insulating layer.

23. An electroacoustic transducer according to claim 19, wherein the oscillation portion has at least one hole defined therein for allowing the cavity to communicate with the atmosphere/air.

24. An electroacoustic transducer according to claim 19, wherein the upper electrode and the lower electrode are each connected to a terminal formed by a gold bump for applying voltage.

* * * * *